US012480327B2

(12) United States Patent
Pescovitz

(10) Patent No.: US 12,480,327 B2
(45) **Date of Patent: *Nov. 25, 2025**

(54) COLLAPSIBLE ENCLOSURE

(71) Applicant: Under the Weather, LLC, Cincinnati, OH (US)

(72) Inventor: Eric Frank Pescovitz, Cincinnati, OH (US)

(73) Assignee: Under the Weather, LLC, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/131,720

(22) Filed: Apr. 6, 2023

(65) Prior Publication Data

US 2023/0243178 A1 Aug. 3, 2023

Related U.S. Application Data

(63) Continuation of application No. 15/558,852, filed as application No. PCT/US2016/022454 on Mar. 15, 2016, now Pat. No. 11,639,614.

(Continued)

(51) Int. Cl.
*E04H 15/40* (2006.01)
*E04H 15/00* (2006.01)

(Continued)

(52) U.S. Cl.
CPC ..... *E04H 15/40* (2013.01); *E04H 15/006* (2013.01); *E04H 15/18* (2013.01); *E04H 15/405* (2013.01); *A63H 33/008* (2013.01)

(58) Field of Classification Search
CPC ..... E04H 15/405; E04H 15/40; E04H 15/006; A63H 33/008
See application file for complete search history.

(56) References Cited

U.S. PATENT DOCUMENTS 4,000,585 A 1/1977 Denaro
4,800,597 A 1/1989 Healey
(Continued)

FOREIGN PATENT DOCUMENTS

EP 1359269 A1 11/2003
EP 3271528 A1 1/2018
(Continued)

OTHER PUBLICATIONS

European Patent Office, Extended Search Report issued in EP App. No. 24152094.9-1005, dated May 7, 2024 (9 pages).

*Primary Examiner* — David R Dunn
*Assistant Examiner* — Danielle Jackson
(74) *Attorney, Agent, or Firm* — Wood Herron & Evans LLP

(57) ABSTRACT

A collapsible enclosure includes a body formed by a plurality of walls including a front, a back, a first side, a second side, a top, and a bottom wall coupled to one another to form an interior. Each wall includes at least one of a plurality of deformable frame members. A window is defined in one of the front, back, first side and second side wall, and is selectively engageable with the respective wall such that the window is disposable between an open and closed position. A door is defined in one of the front, back, first side, and second side wall, and is further selectively engageable with the respective wall such that the door is disposable between an open and closed position. The front wall defines a first plane and the back wall defines a second plane, the first plane and second plane are substantially parallel to one another.

17 Claims, 18 Drawing Sheets

Related U.S. Application Data

(60) Provisional application No. 62/297,315, filed on Feb. 19, 2016, provisional application No. 62/134,029, filed on Mar. 17, 2015.

(51) Int. Cl.
*E04H 15/18* (2006.01)
*A63H 33/00* (2006.01)

(56) References Cited

U.S. PATENT DOCUMENTS 4,941,499 A 7/1990 Pelsue et al.
5,222,513 A 6/1993 Hilliard
5,394,897 A * 3/1995 Ritchey ..... E04H 15/18 52/79.8
5,560,385 A 10/1996 Zheng
5,592,961 A * 1/1997 Chin ..... E04H 1/1244 135/117
6,138,701 A * 10/2000 Zheng ..... E04H 15/40 446/478
6,305,396 B1 10/2001 Zheng
6,357,462 B1 3/2002 Laosunthara et al.
6,494,224 B2 12/2002 Zheng
6,782,905 B2 8/2004 Chu et al.
7,040,333 B1 5/2006 Ransom et al.
7,137,399 B1 * 11/2006 Ransom ..... E04H 15/32 52/79.5
7,357,140 B2 4/2008 Chu et al.
7,523,719 B2 4/2009 Miller et al.
7,588,045 B2 9/2009 Goodwin et al.
7,600,348 B1 10/2009 Kostka
7,614,415 B1 11/2009 Wehner
8,042,562 B1 10/2011 McDaniel, Jr.
D711,997 S * 8/2014 Pescovitz ..... D21/834
D711,998 S * 8/2014 Pescovitz ..... D21/834
D725,735 S * 3/2015 Pescovitz ..... D21/838
9,470,010 B2 10/2016 Youn
D776,779 S * 1/2017 Pescovitz ..... D21/836
D790,024 S * 6/2017 Pescovitz ..... D21/838
9,752,345 B1 9/2017 LaHood
D814,590 S * 4/2018 Pescovitz ..... D21/838
10,323,435 B2 * 6/2019 Ferrara ..... E04H 15/001
11,060,316 B2 * 7/2021 Pescovitz ..... B65D 21/0233
11,639,614 B2 * 5/2023 Pescovitz ..... E04H 15/405 135/125
2005/0039388 A1 2/2005 Wehner
2005/0081903 A1 4/2005 Wang
2006/0169309 A1 * 8/2006 Brackins ..... E04H 15/14 135/119
2007/0193614 A1 8/2007 Egstad
2013/0192146 A1 8/2013 Anklam
2013/0306121 A1 11/2013 Hung Lau
2023/0085227 A1 * 3/2023 Xu ..... E04H 15/64 135/97

FOREIGN PATENT DOCUMENTS

KR 100928451 B1 11/2009
KR 101059100 B1 8/2011
WO 9427005 A1 11/1994

* cited by examiner

COLLAPSIBLE ENCLOSURE

CROSS-REFERENCE TO RELATED APPLICATIONS

This application is a continuing application of U.S. patent application Ser. No. 15/558,852, filed Sep. 15, 2017, which was a national phase entry of, and claimed priority to, International Application No. PCT/US2016/022454 filed on Mar. 15, 2016, which claimed priority to U.S. Provisional Patent Application 62/134,029, filed Mar. 17, 2015, and U.S. Provisional Patent Application 62/297,315, filed Feb. 19, 2016. The above-mentioned patent applications are incorporated herein by reference in their entireties.

TECHNICAL FIELD

The present disclosure relates to an apparatus and method for creating a personal enclosure, and more specifically a personal enclosure that can be coupled to another personal enclosure

BACKGROUND

Outdoor athletic and entertainment events are very frequently observed live by players and an audience. In many outdoor venues the people attending do not have any form of shelter from the elements. In these outdoor venues, the spectators or players may have no choice but to stand in the rain, sleet, snow, or wind if precipitation occurs during the event they are attending.

One method used to combat undesirable weather conditions during an outdoor event is to use an umbrella to provide limited shelter from any precipitation that is descending from the skies. Umbrellas, however, only provide minimal shelter, and leave a majority of the user's body exposed to the elements. Alternatively a typical camping tent may provide better shelter from the elements, but not allow the user to adequately observe the live event or interact with surrounding event-goers. These conventional camping tents also can be difficult to assemble and disassemble.

Personal attendance of outdoor events has proven to be desirable in spite of adverse weather conditions. While umbrellas and camping tents can be used to provide protection from adverse weather, umbrellas only provide minimal coverage and tents do not allow easy observation of the live event. Accordingly, there is a need for an enclosure that allows unobstructed views of the event, full protection from the elements, and an opportunity to interact with fellow event attendees.

SUMMARY

In a first embodiment of the present disclosure, a collapsible enclosure for accommodating a user includes a body formed by a plurality of walls including at least a front wall, a back wall, a first side wall, a second side wall, a top wall, and a bottom wall coupled to one another to form an interior, the interior configured to be occupied by the user; a plurality of deformable frame members, wherein each of the front wall, the back wall, the first side wall, and the second side wall includes at least one of the plurality of deformable frame members; a window defined in one of the front wall, back wall, first side wall and second side wall, wherein the window is selectively engageable with the respective wall such that the window is disposable between an open and closed position; and a door defined in one of the front wall, back wall, first side wall, and second side wall, wherein the door is selectively engageable with the respective wall such that the door is disposable between an open and closed position; wherein, the front wall defines a first plane and the back wall defines a second plane, the first plane and second plane are substantially parallel to one another; further wherein, the body is collapsible between an upright configuration that defines the interior and a collapsible configuration.

In one example of this embodiment, wherein the door includes a first door defined in the front wall, a second door defined in the first side wall, and a third door defined in the second side wall. In a second example, the second door and third door are selectively engageable with the first side wall and second side wall, respectively. In a third example, at least one of the second door and third door is foldable in a direction towards the back wall when selectively disengaged from the respective wall. In a fourth example, wherein the window is defined in an upper half or lower half of the respective wall, and the door is defined in both the upper and lower halves of the respective wall. In a fifth example, wherein the first side wall defines a third plane and the second side wall defines a fourth plane, the third plane and fourth plane being substantially parallel to one another, and the first and second planes being substantially perpendicular to the third and fourth planes.

In a sixth example, a removable roof is formed of water impermeable material and including at least one connector, the at least one connector being removably coupled to the body. In a seventh example, at least one strap is coupled to the body, the at least one strap defining an opening for receiving the at least one connector of the roof. In an eighth example, a second window is defined in and selectively engageable with one of the front, back, first side and second side walls, the second window having a height and width which are smaller than a height and width of the first window. In a ninth example, the second window is defined in the same wall as the first window. In another example, the second window is defined in the same wall as the door. In a further example, wherein the door comprises a first door and a second door, the first door being defined in and selectively engaged with the front wall and the second door being defined in and selectively engaged with the back wall; wherein, the first door is spaced by a first distance from the bottom wall, and the second door is spaced by a second distance from the bottom wall, where the second distance is less than the first distance.

An enclosure assembly for accommodating one or more users, including a first enclosure formed by a plurality of walls including at least a front wall, a back wall, a first side wall, a second side wall, a top wall, and a bottom wall coupled to one another to form an interior, where each of the front wall, the back wall, the first side wall, and the second side wall includes at least one frame member; a second enclosure formed by a plurality of walls including at least a front wall, a back wall, a first side wall, a second side wall, a top wall, and a bottom wall coupled to one another to form an interior, where each of the front wall, the back wall, the first side wall, and the second side wall includes at least one frame member; a roof structure including a plurality of connectors for coupling the first enclosure and the second enclosure to one another to form the assembly, the roof structure positioned above the top walls of the first and second enclosures; wherein the first enclosure includes a first door defined in and selectively engageable with the first or second side wall; the second enclosure includes a second door defined in and selectively engageable with the first or second side wall; further wherein, a passageway is defined between the first enclosure and second enclosure when the first enclosure is adjacent to the second enclosure and the first door and second door are opened and aligned with one another, the passageway configured to allow a user to travel therethrough between the interiors of the first enclosure and the second enclosure.

In a first example, a third door is defined in the wall of the first enclosure opposite the first door; a fourth door is defined in the wall of the second enclosure opposite the second door; wherein, the third door and fourth door each define access to the passageway and an entrance or exit opening of the assembly. In a second example, wherein the front wall of the first or second enclosure includes a door defined in and selectively engageable thereto. In a third example, wherein the front, back, first side and second side walls of the first and second enclosures are either parallel or perpendicular to one another. In a fourth example, wherein the front, back, first side and second side walls of the first and second enclosures taper inwardly from the respective bottom wall to the respective top wall. In a fifth example, a window is defined in one of the front wall, back wall, first side wall and second side wall of the first or second enclosure, wherein the window is selectively engageable with the respective wall such that the window is disposable between an open and closed position; and a second window defined in and selectively engageable with one of the front, back, first side and second side walls of the first or second enclosure, the second window having a height and width which are smaller than a height and width of the first window.

In another example, a third door is defined in and selectively engageable with the front wall of the first enclosure; and a fourth door defined in and selectively engageable with the back wall of the first enclosure; wherein the third door is spaced by a first distance from the bottom wall, and the fourth door is spaced by a second distance from the bottom wall, where the second distance is less than the first distance. In a further example, a third enclosure is formed by a plurality of walls including at least a front wall, a back wall, a first side wall, a second side wall, a top wall, and a bottom wall coupled to one another to form an interior, where each of the front wall, the back wall, the first side wall, and the second side wall includes at least one frame member; wherein the third enclosure includes a door defined in and selectively engageable with the first or second side wall; the second enclosure includes a third door defined in the side wall opposite the second door; the roof structure is removably couples the third enclosure to the first and second enclosures; and the passageway is defined between the first, second, and third enclosures when the first enclosure is adjacent to the second enclosure, the second enclosure is adjacent to the third enclosure, and the first door, the second door and the third door are opened and aligned with one another, the passageway configured to allow a user to travel therethrough between the interiors of the first, second, and third enclosures.

In a further embodiment, a collapsible enclosure for accommodating a user includes a body formed by a plurality of walls including at least a front wall, a back wall, a first side wall, a second side wall, a top wall, and a bottom wall coupled to one another to form an interior, the interior configured to be occupied by the user; a plurality of frame members, wherein each of the front wall, the back wall, the first side wall, and the second side wall includes at least one of the plurality of frame members; a window defined in one of the front wall, back wall, first side wall and second side wall, wherein the window is selectively engageable with the respective wall such that the window is disposable between an open and closed position; and a door defined in at least the front wall, wherein the door is selectively engageable with the front wall such that the door is disposable between an open and closed position; a loop coupled to the body near the bottom wall, the loop defining an opening adapted to receive a stake; a strap coupled to the body and defining an opening for receiving a connector from a separate roof structure; wherein, the body is configurable between an upright configuration that defines the interior and a collapsible configuration; further wherein, the body is collapsible from its upright configuration to its collapsible configuration such that the door is opened and folded into the interior of the enclosure; with the enclosure resting on its back wall, the first side wall is folded into the interior and on top of the back wall; the frame member of the first side wall is straightened into alignment with the frame members of the second side wall and the back wall; the second side wall is folded on top of the first side wall and back wall so that the enclosure forms a substantially flat enclosure; a top half of the substantially flat enclosure is folded in half towards a bottom half thereof; a first side of the top half is twisted and folded against the bottom half; and a second side of the top half is twisted and folded against the bottom half.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

Figure 1:
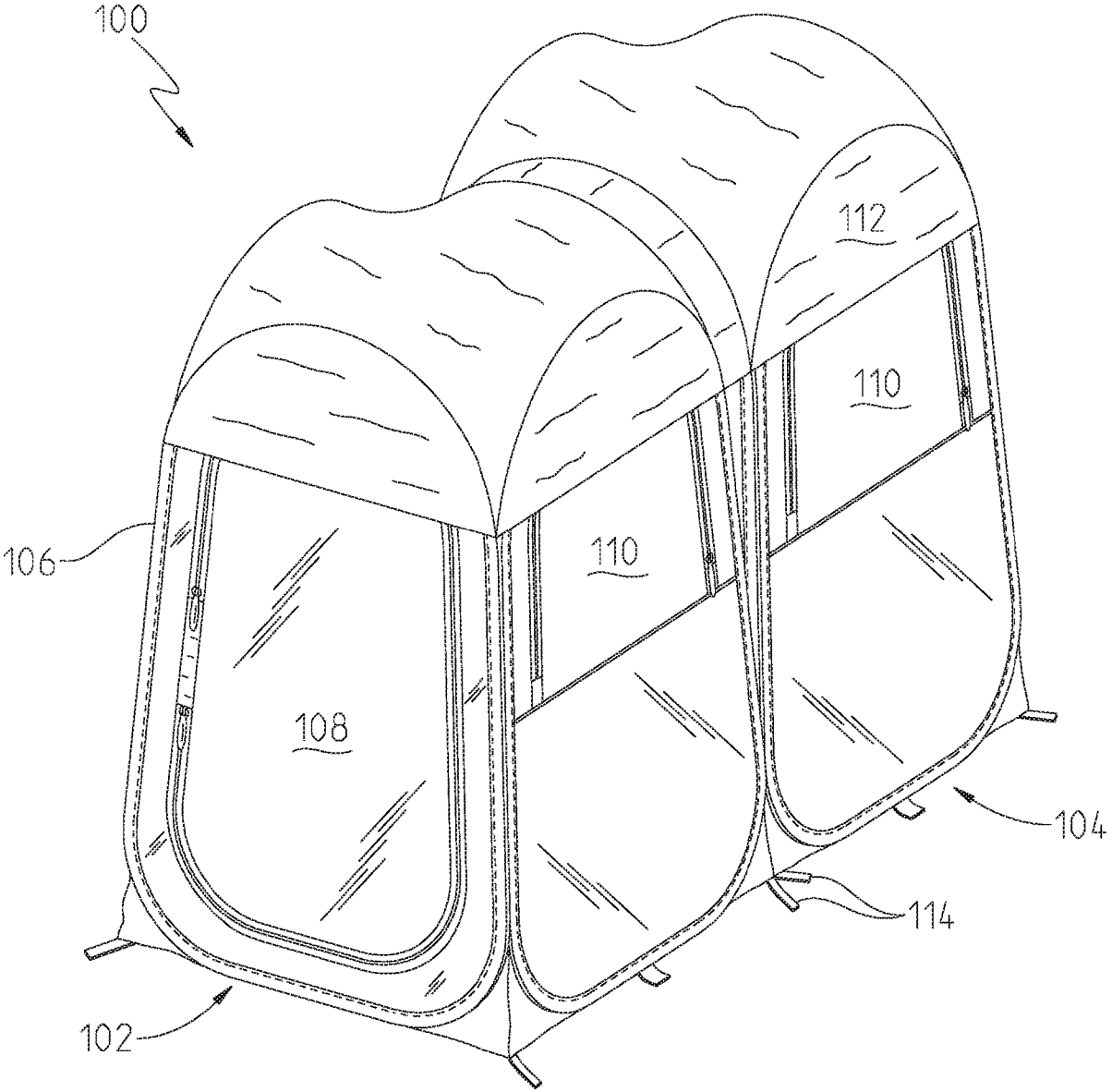
FIG. 1 is an elevated perspective view of the multiple enclosure coupling assembly of the present disclosure.

Referring to FIG. 1, one embodiment of a multi-enclosure assembly 100 is shown. The multi-enclosure assembly 100 may include a first pod 102 and a second pod 104, although it is not limited to only two pods. The first and second pod 102, 104 may be a synthetic, cloth, or cloth-like material that is disposed around or between at least one frame element 106 to define a first and second inner cavity. The first pod 102 and the second pod 104 may each also define at least one door 108 and at least one window 110. Both the door 108 and the window 110 may be positionable between a closed position (as seen in FIG. 1) and an open position. The door 108 and window 110 may be held in the fully closed position by a plurality of fasteners. In one non-exclusive embodiment, a zipper may be used to uncouple portions of the door 108 or window 110 from the first or second pod 102, 104. Alternatively, magnets, buttons, Velcro, or any other common coupling means as is known in the art could be used to perform the coupling feature.

The material disposed between the frame element 106 may be an impermeable material that can substantially encapsulate the first and second inner cavity when any door 108 or window 110 is in the closed position. Further, the material may be any number of colors or may be substantially clear. A person having skill in the relevant art understands the advantages of utilizing a clear material so that the surrounding area can be observed by anything located in the inner cavity. Alternatively any combination of colored or clear material may be used. In one embodiment, a substantial portion of the pod may be formed by a camouflage material while only a small portion of the material is clear. In FIG. 1, and in many of the other embodiments disclosed herein, broken lines shown in the illustrated embodiments may represent a stitch line or the like of material used for making the enclosure or stitching various sides to one another.

The door 108 may consist of a majority of a side of one of the pods 102, 104. The door 108 may be substantially uncoupled from the side in the open position. In the open position, the door may be rolled, folded, or the like to become disposed along one side of the door opening. Once removed from the door opening, the door may be held in its open position by a removable coupler, such as Velcro®, snap, clip, latch, one or more ties, buttons, magnetic members, or the like. In the open position, the door 108 may be held substantially away from the door opening. In a different embodiment, the door 108 may be completely uncoupled and removed from the pod.

Each window 110 may similarly be disposed along a portion of a side of either pod 102, 104. In the open position the window 110 may also have an open, compact position that leaves a portion thereof substantially unobstructed. The window 110 may be held in the open, compact position by a removable coupler, such as Velcro®, snap, clip, latch, one or more tie, one or more button, one or more magnetic member, or the like. Alternatively, the window 110 may be entirely uncoupled and removed from the pod 102, 104 in its open position.

In one embodiment, the first pod 102 and the second pod 104 may each have at least two doors 108 disposed on sides that are substantially opposite from one another. Positioning the two doors 108 along sides opposite one another in each pod 102, 104 may allow a user to enter the pod 102, 104 on one side and exit on the opposite side. The skilled artisan will understand that a door may be located on any particular side of either pod 102, 104 depending on the needs of the user. In one non-limiting example, a removable door can be disposed on each side of either pod 102, 104. Accordingly, this disclosure is not limited to any one particular door configuration.

In one embodiment, the first pod 102 and the second pod 104 may become disposed side-by-side. In this disposition, one of the doors 108 of the first pod 102 may be aligned with one of the doors 108 of the second pod 104. An area surrounding the doors 108 of the first pod 102 and the second pod 104 may have a coupling means that allows both pods to couple to one another such that both door openings are aligned with one another. In one embodiment, the coupling means may be magnets disposed along the opening of each door 108. When the magnets contact one another, they may couple the first pod 102 to the second pod 104. In this configuration, the inner cavity of the first pod 102 may be coupled to the inner cavity of the second pod 104 so that a user may maneuver between both pods.

The door openings between the first pod 102 and the second pod 104 may be coupled using any number of a plurality of coupling mechanisms. For example, instead of magnets, the door opening of the first pod 102 may be coupled to the opening of the second pod 104 via at least one button, zipper, Velcro, ties, or any other similar coupling means. Accordingly, this disclosure is not limited to any one configuration.

Yet another aspect of the present disclosure is a removable roof 112. The roof 112 may be positionable above the first and second pods and is adapted to couple an upper portion of the first pod 102 and the second pod 104 to one another when the first and second pod 102, 104 are arranged adjacent to one another. In one embodiment, the roof 112 may be coupled to frame 106 of both the first pod 102 and the second pod 104. The roof 112 may be coupled to the frame using a plurality of coupling means such as, for example, buttons, zippers, Velcro, ties, hooks or any other coupling means. In one embodiment, the roof 112 may provide an additional water barrier (besides a top side of each pod) along the top portion of the first and second pod 102, 104. Additionally, the roof 112 may provide a water barrier along the area where the first pod 102 and the second pod 104 are coupled to one another. Further, the roof 112 may act as a reinforcement to maintain the first pod 102 and the second pod 104 in the two enclosure assembly 100.

Each of the first pod 102 and the second pod 104 may also contain at least one anchoring or latching means 114 to anchor the pod 102, 104 to the underlying ground surface. The anchoring means 114 can be an extension of the material from the frame 106 that can become disposed along the underlying surface. Further, in one embodiment, the anchoring means 114 may terminate at a loop. The loop may therefore provide a location to drive a stake or other securing means through the anchoring means 114 and into the underlying ground surface to hold or maintain the pod from moving. In one embodiment, there may be an anchoring means 114 at each bottom corner of each pod 102, 104.

The frame 106 may be composed of a material having sufficient elastic properties to allow the frame to be manipulated by a user into multiple configurations yet strong enough to maintain the material in a position defining the inner cavity. Further, the frame 106 and material may be configured to allow the user to manipulate each pod 102, 104 to become disposed in a substantially flat or collapsed configuration (not shown). In the collapsed configuration, a user may easily transport or store each pod 102, 104.

In one embodiment, the user may have the first pod 102 in its collapsed configuration. The user may manipulate the frame 106 and the material of the first pod 102 so that it becomes assembled in its upright position that defines the inner cavity. The user may then orient one of the doors 108 in the fully open position. Next, the user may have a second pod 104 in its flat or collapsed configuration. The user may manipulate the frame 106 and the material of the second pod 104 so that it becomes disposed in its upright position that defines the inner cavity. Next, the user may orient one of the doors 108 of the second pod 104 into the open position. The user may then position the door opening of the first pod 102 next to the door opening of the second pod 104. The user may then couple the first pod 102 door opening to the door opening of the second pod using one of the plurality of coupling means described above. Finally, the user may couple the roof 112 to the frame member 106 of each the first pod 102 and the second pod 104 utilizing one of the plurality of coupling means described above.

A user can manipulate the first and second pod 102, 104 into many different configurations when coupled to one another. For example, the door 106 that is positioned along the exterior of the first pod 102 may allow entry into the inner cavity of the coupled first and second pod 102, 104. Alternatively, the door 106 along the exterior of the second pod 104 may also be in the open position. In this configuration, the first and second pod 102, 104 may define a passageway therebetween where a user can enter one end of one pod and exit an end of the other pod. Each exterior door 106 may also be positioned in the closed orientation when a user is located within the inner cavity. In this orientation, the user may be substantially protected from the surrounding elements. For example, a user can put a chair in the inner cavity of the pod so that the user can sit and watch a sporting event or concert while being protected from the weather or insects outside of the pod. In yet another orientation, the exterior doors may be in the closed position while one or more of the windows 110 may be in the open position.

Figure 2:
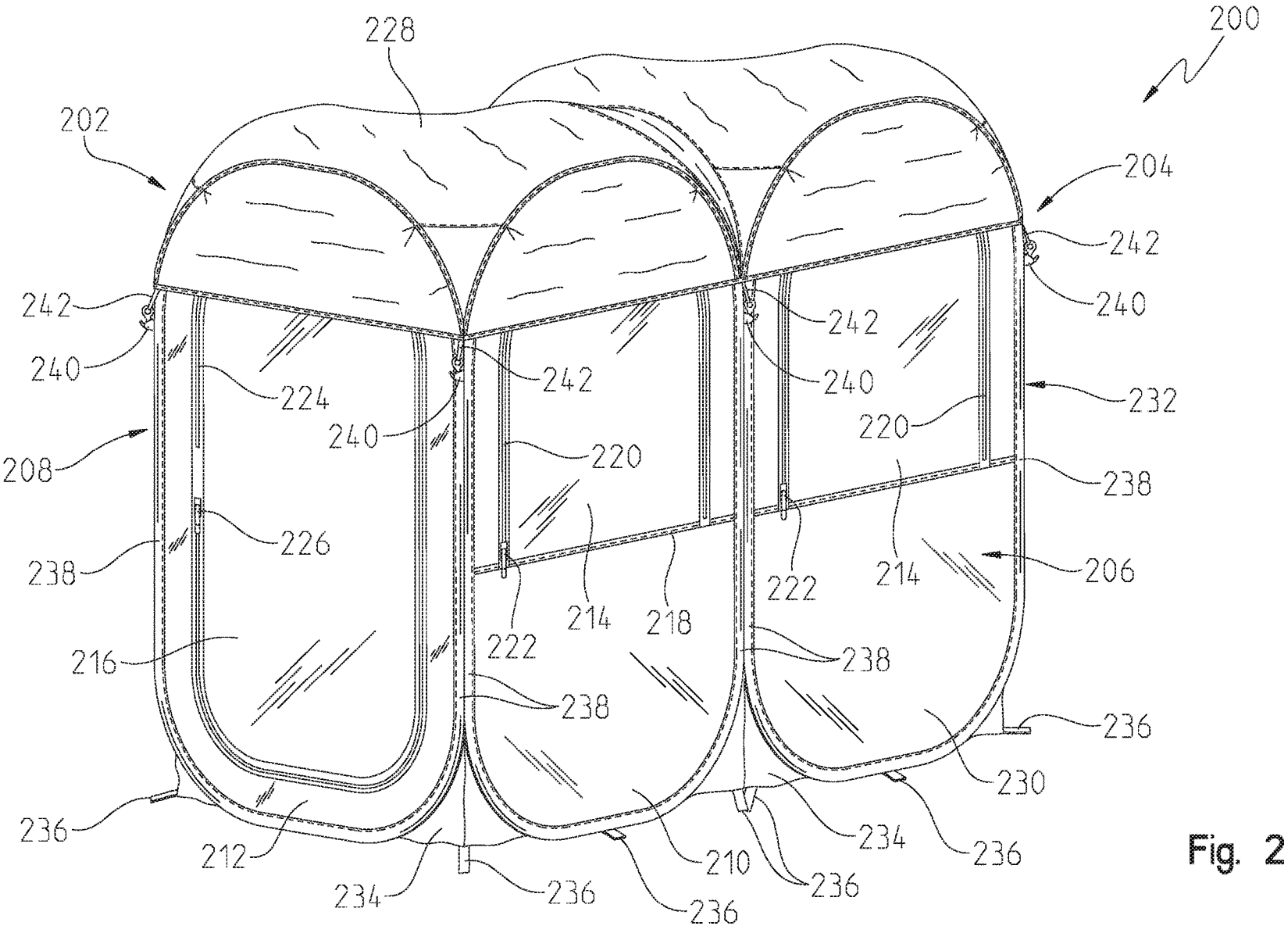
FIG. 2 is a front side perspective view of another embodiment of a multiple enclosure coupling assembly.

The aforementioned pods may include substantially parallel planar sides, as shown in FIG. 2. In this configuration, when the pods are coupled one another, the side surface of one pod may substantially align with the surface of another pod. Similarly, the frame members of each pod may be substantially aligned with one another, allowing the pods to easily couple to one another as described above. The roof may also hold the sides in alignment with one another in this configuration.

Alternatively, in a different embodiment the sides may be tapered from the bottom of the pod to the top. In this embodiment, the base or bottom of the respective pod is larger than the top. An example of this is shown in FIGS. 10-14 of the present application, and will be described in further detail below.

While a first and second pod 102, 104 have been described in detail with respect to FIG. 1, any number of pods may be used. In one non-limiting example, two or more pods may be coupled to one another and have a corresponding roof configured to couple the two or more pods to one another. In yet another example, four or more pods may be coupled together based on this disclosure. A larger roof may be used for coupling the pods to one another than shown in FIG. 1. This disclosure is not intended to be limited to any particular number, however, as there is no numerical limitation to the number of pods that may be implemented.

Referring to FIG. 2, a second embodiment of the present disclosure is shown. Here, another multi-enclosure assembly 200 is shown formed by a first enclosure or pod 202 and a second enclosure or pod 204. In this embodiment, the multi-enclosure assembly 202 includes a front side 206 and a back side 208. In some instances, the front and back sides may be similar. In this embodiment, the first enclosure 202 includes a plurality of sides that define an interior cavity for a user to occupy. The plurality of sides may include a front 210, a rear, a first side 212, a second side, a top, and a bottom. In this embodiment, the first enclosure 202 includes at least six different sides. The same is true of the second enclosure. In other embodiment, however, each enclosure may have fewer than six total sides. For instance, it may be possible to have a cylindrically-shaped enclosure with a top and bottom. Alternatively, a triangularly-shaped enclosure with a top and bottom may include five sides. A pentagon-shaped enclosure with a top and bottom may include seven sides. In other example, an enclosure may not have a bottom at all, and thus it may be open at the bottom. Other types of arrangements are contemplated in this disclosure. Moreover, the second enclosure 204 may also include a front 230, a rear, a pair of sides 232, a top and a bottom.

In FIG. 2, the front 210 of the first and second enclosures each include a window 214 defined at least in a portion thereof. In this illustrated embodiment, the window 214 is formed in an upper portion of the front 210, and a seam 218 defined transversely across the front 210 separates the window 214 from a lower portion of the front 210. This is only an example, however, of one type of window 214 that may be formed in an enclosure. The size of the window 214 may vary. For example, if the enclosure is sized for a user to sit in a chair while occupying the enclosure, the window may be positioned lower than it is shown in FIG. 2. Alternatively, if the enclosure is sized for a user to stand while occupying the enclosure, the window may be disposed higher or as shown in FIG. 2. Thus, the size and location of the window 214 may vary in different embodiments.

The first side 212 of the first enclosure 202 is shown having a door 216 formed therein. The door 216 may have any size. As shown in FIG. 2, the door 216 may occupy a majority of the first side 212 so that it defines an opening for a user to enter or exit therethrough. Any of the front, back or sides of each enclosure may include either a window 214 or door 216, as shown. The window 214 or door 216 may be opened or closed via a zipper 224. Each zipper 224 may include a zipper pull 226 for opening or closing the window or door. In some instances, more than one zipper pull may be provided for opening or closing a window or door.

In FIG. 2, each of the sides is shown having a frame member 238. The frame member 238 may be formed of any flexible or pliable material that allows the enclosure to collapse from its upright position. In its collapsed position, the enclosure is easily transportable and may be stored more easily than in its upright position. The manner in which the enclosure may be folded or collapsed to its collapsed position will be described in further detail below. In any event, the frame 238 may bias the enclosure to its upright position similar to a pop-up style tent. As such, the frame may be formed of a light steel or metallic material. Alternatively, the frame may be formed of a plastic material.

In the illustrated example, each of the sides shown in FIG. 2 is formed of a square-like shape. In this manner, the front and rear of each enclosure may be substantially parallel to one another. The frame 238 may have an oval or egg-shaped design. In some instances, the various sides or walls of each enclosure may also be shaped like an oval or egg-shape.

Each enclosure may be formed of an impermeable material so that water may not enter or leak into the interior thereof. Thus, a user may occupy the enclosure in its upright position without being exposed to rain, snow, wind, insects, or other conditions outside of the enclosure. Each side may also be formed of a material that reflects sun light so that a user can avoid getting a sun burn while occupying the enclosure.

Moreover, a removable, separate roof structure 228 may also be used when connecting or coupling two or more enclosures to one another. The roof structure 228 may be positioned above each enclosure, and thus the roof structure provides further protection against rain, snow, wind, insects, etc. The roof structure 228 may have any type of shape or design (including decorative), and it may include one or more connectors 242 as shown in FIG. 2. Each connector 242 may engage or couple to a loop or strap 240 that is connected to an enclosure. The loop or strap 240 may be a piece of cloth with an opening for receiving the connector 242. The connector 242 may include a hook or latch that engages with the loop or strap 240. Once connected, the roof structure 228 may allow for multiple enclosures to be coupled to one another such as shown in FIG. 2.

The roof structure 228 also provides a continuous structure overhead of the connected enclosures. As such, when the first enclosure 202 and second enclosure 204 are positioned in close proximity to one another, and doors on each side of the respective enclosures are aligned with one another in their open positions, a user may pass through and between each enclosure without having to go outside of either enclosure. The roof structure 228 provides protection against inclement weather or insects so that a user may occupy either or both of the enclosures. The two enclosures thus define a walkway or path therebetween. An example of this is further shown in FIG. 18.

Figure 18:
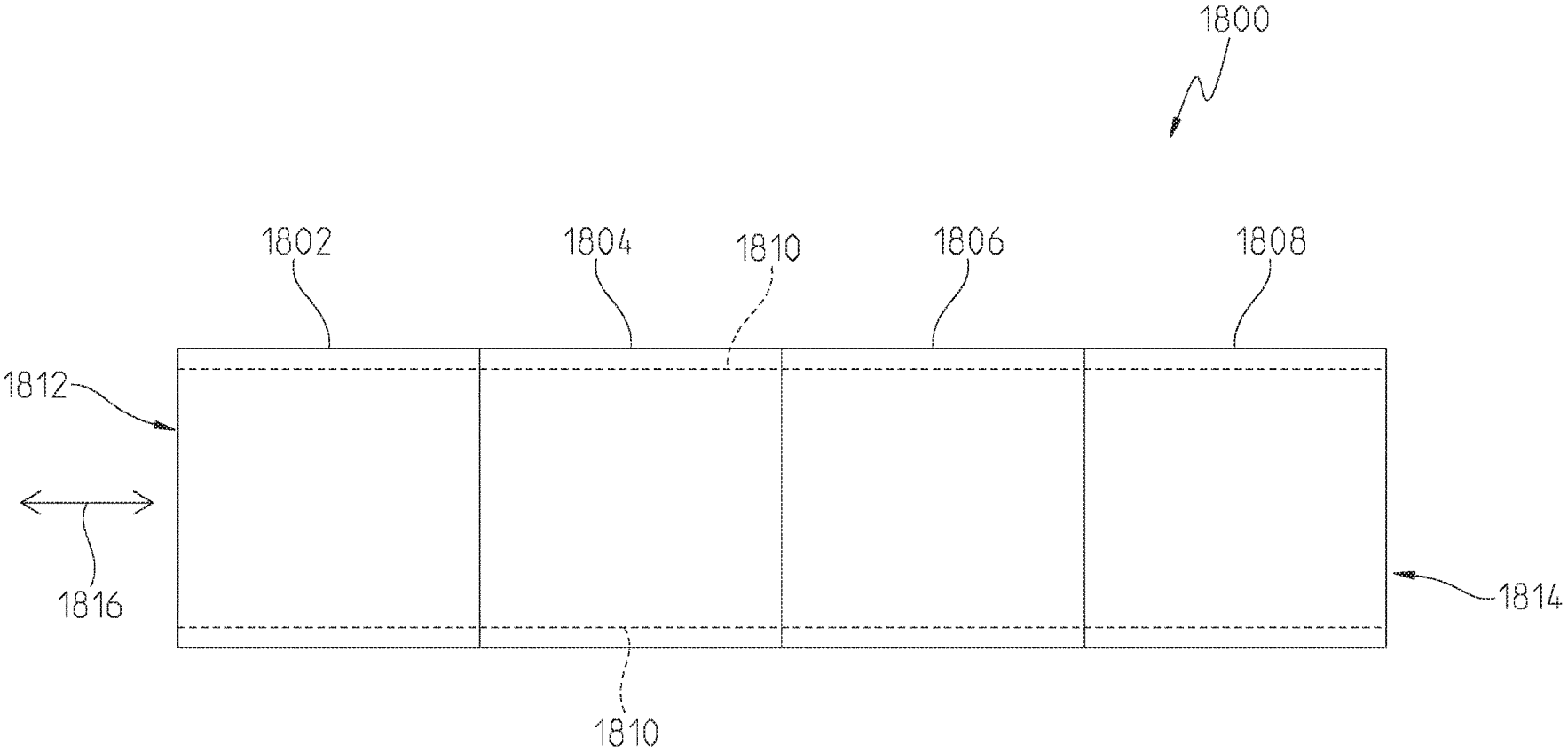
FIG. 18 is a schematic top view of the multiple enclosure coupling assembly of FIG. 2.

In FIG. 18, a multi-enclosure assembly 1800 similar to that of FIG. 2 is shown. Here, the assembly 1800 may include a first enclosure 1802, a second enclosure 1804, a third enclosure 1806, and a fourth enclosure 1808. Each enclosure is aligned with another to form a rectangular alignment. When the enclosures are of a different shape, the alignment may appear differently from above. In any event, the assembly 1800 includes a first end 1812 that defines a first opening and an opposite end 1814 that defines a second opening. In this embodiment, doors are located at each of the two ends so a user may enter the first and fourth enclosures. Moreover, a door in the first enclosure 1802 may be aligned with a door in the second enclosure 1804. Likewise, a door in the second enclosure 1804 may be aligned with a door in the third enclosure 1806, and a door in the third enclosure 1806 may be aligned with a door in the fourth enclosure 1808. Thus, in this embodiment, each of the enclosures includes at least two doors on opposite sides thereof.

When each door is in its open position, a walkway or passageway 1810 is defined in the assembly between each enclosure. As such, a user may enter either the first end 1812 or the second end 1814 and move through the passageway 1810 in either direction as indicated by arrow 1816. It should be appreciated that in those enclosures with three or more doors or openings, enclosures may be arranged in multiple directions (e.g., in longitudinal and transverse directions). In one example, multiple enclosures may be coupled to one another to form a circular, enclosed structure. In a second example, multiple enclosures may be coupled to one another to form a cross-like, enclosed structure. In a further example, an assembly may include two or more rows and columns of enclosures coupled to one another to form a single enclosure with passageways defined along each row and column. In at least one embodiment, the front, rear, or sides of each enclosure may include connectors such as snaps, latches, hooks, Velcro®, and the like for connecting to adjacent enclosures.

A roof structure 228 similar to that in FIG. 2 may also be used to couple multiple enclosures to one another so that travel between adjacent enclosures may occur without being exposed to outside conditions. As such, the roof structure 228 forms a continuous structure that can stretch between and couple two or more enclosures.

Returning to FIG. 2, each enclosure may also include an anchoring means or loop 236 near the bottom thereof. A stake or other anchor may be driven through an opening in the anchoring means or loop 236 and into the ground for holding or maintaining the enclosure in place. Thus, the stake or anchor may hold the enclosure in place in spite of the wind, rain, or snow.

Figure 3:
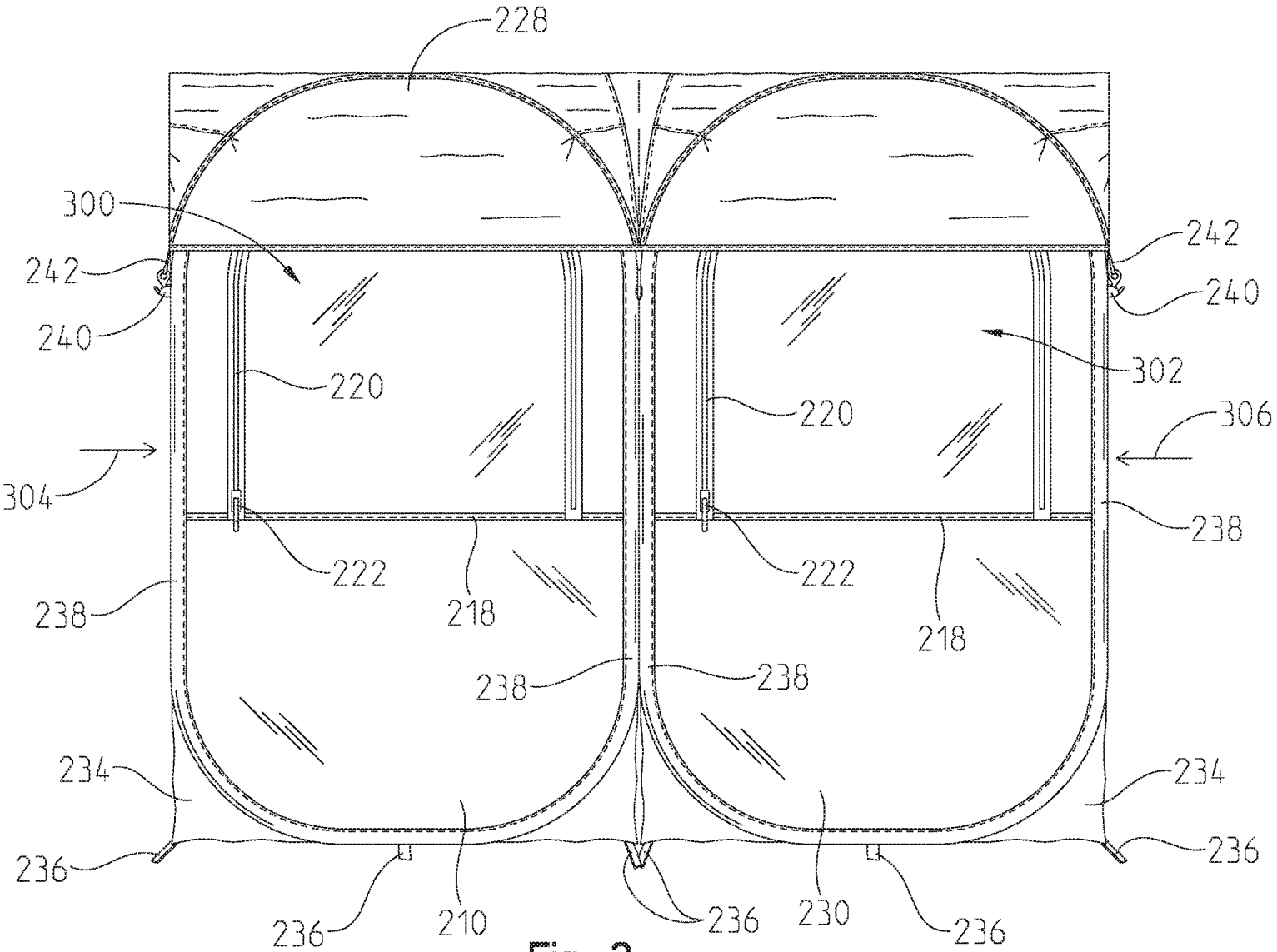
FIG. 3 is a front view of the assembly of FIG. 2.

Referring to FIG. 3, the multi-enclosure assembly 200 of FIG. 2 is shown from its front side 206. Although stated previously, the first enclosure 202 may define a first interior or internal cavity 300 that may be occupied by a user. Similarly, the second enclosure 204 may define a second interior or internal cavity 302. With doors on each side of the two enclosures, a user may enter the first enclosure 202 via a first opening 304 or the second enclosure 204 via a second opening 306. If the doors on the sides of the two enclosures facing one another are open, then a user may pass between each enclosure.

Figure 4:
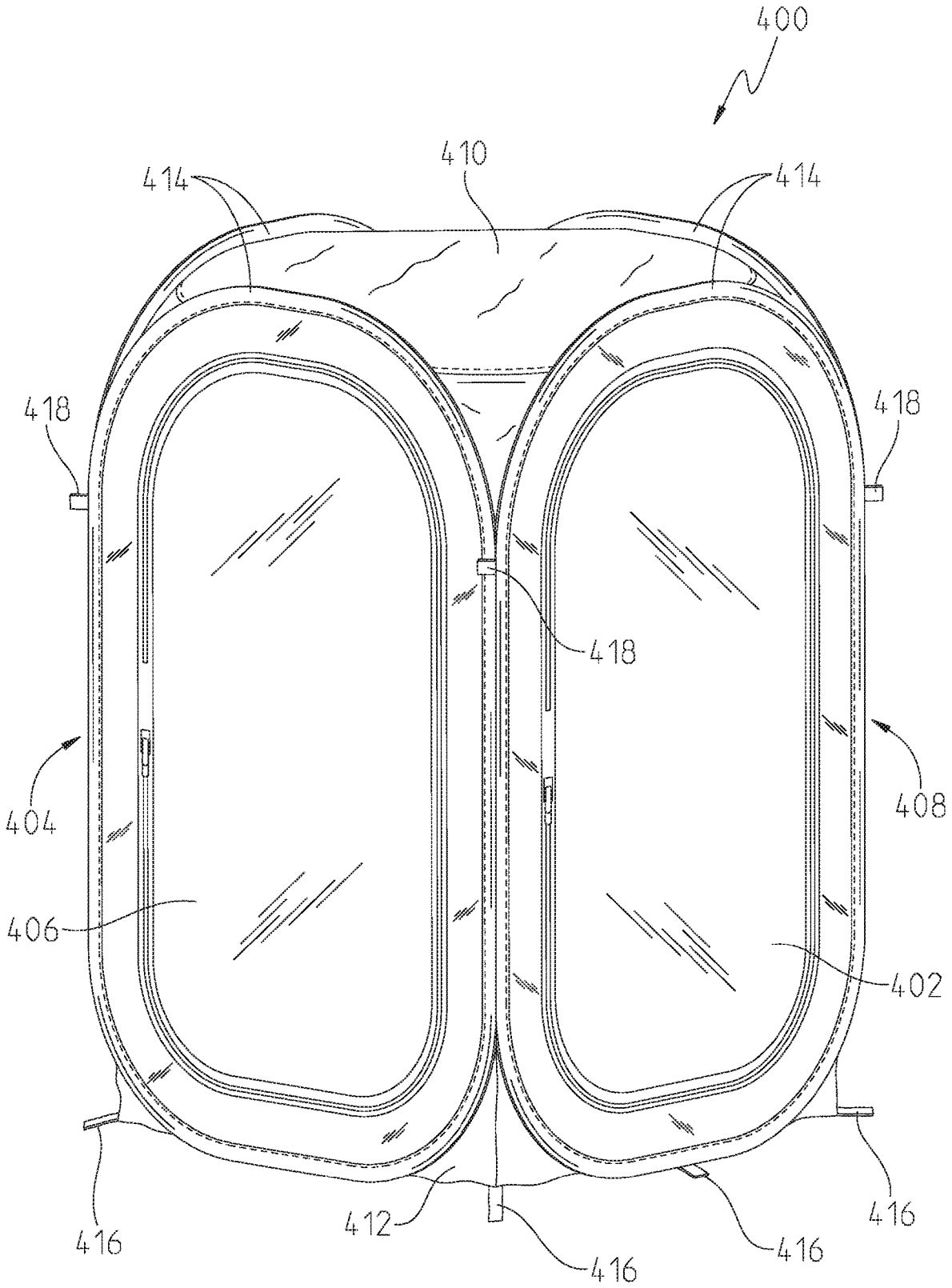
FIG. 4 is a perspective view of one embodiment of a personal enclosure.

In FIG. 4, a different embodiment of an enclosure 400 is shown. Here, only a single enclosure is shown but it is understood that this enclosure 400 may be arranged with other enclosures to form a multi-enclosure assembly as previously described. Thus, the teachings of this disclosure apply to this embodiment and the other embodiments described herein.

The enclosure 400 may include a plurality of sides including a front wall 402, a back wall 404, a first side wall 406, and a second side wall 408. Each wall may be formed of a water impermeable material to prevent water from leaking or getting into the interior of the enclosure. Each wall may also include a frame structure 414 that provides stability to the enclosure and maintains it in its upright position. Each frame structure 414, however, may be flexible, bendable, pliable, etc. such that the enclosure may be folded or collapsed into a collapsed or storage position. This allows the enclosure to be easily transported or stored.

The enclosure 400 may also include a top 410 and a bottom 412. In some embodiments, the bottom 412 may be omitted so that the enclosure is open at its bottom end. The top 410 may be formed of a multi-layer material to further inhibit water from leaking into the interior of the enclosure. As shown, the bottom 412 may include loops 416 through which a stake or anchor may be driven through to hold the enclosure in place. As also shown, the enclosure 400 may include straps 418 at one or more sides or corners thereof. Similar to the previously described embodiments, the straps 418 may define an opening for receiving a hook or connector of a roof structure. This allows the enclosure 400 to be coupled with one or more other enclosures to form a multi-enclosure assembly.

In FIG. 4, each of the front wall 402, back wall 404, first side wall 406, and second side wall 408 are substantially upright and either parallel or perpendicular with the other walls. For example, the front wall 402 is substantially parallel to the back wall 404 and substantially perpendicular to the first and second side walls. In other words, each wall defines a plane, and each plane is either parallel or perpendicular to the other planes. Moreover, the front wall 402, back wall 404, first side wall 406, and second side wall 408 are substantially perpendicular to the top wall 410 and bottom wall 412.

As such, the top wall 410 and bottom wall 412 may include approximately the same dimensions as one another, and the front, back and side walls may each include approximately the same dimensions (e.g., height and width) as one another. For a person to occupy the interior of the enclosure 400, the height of the front, back and side walls may be appropriately sized to allow a user to either stand or sit in the interior. Moreover, the width of the front, back, and side walls may be sized to allow a chair (e.g., a folding chair, a lawn chair, a wheelchair, etc.) to fit comfortably in the interior. The dimensions and size of the interior of the enclosure 400 are also appropriate considerations with other enclosures described herein.

In this particular embodiment of FIG. 4, it may be easier to align and couple two or more enclosures with one another when the enclosure 400 has a substantially upright orientation with respect to the front, back, and side walls. More particularly, when a roof structure similar to that of FIG. 2 is used to couple adjacent enclosures 400 to one another, the opposing, parallel walls of the adjacent enclosures allow for the enclosures to be positioned next to one another with a minimal gap therebetween.

The structural design of the enclosure 400 in FIG. 4 does allow for the minimal gap between it and a similarly design enclosure. A tapered enclosure, such as those shown in FIGS. 10-15, may also be connected in series with one another, but due to the tapered walls there may be a larger gap between adjacent enclosures (particularly towards the top wall of each enclosure). As a result, a separate roof structure similar to that shown in FIG. 2 may be necessary to allow a user to pass between adjacent enclosures without being exposed to the conditions external to the enclosures. For example, if it is raining or snowing outside of the enclosures, a larger gap (particularly between top walls of adjacent tapered enclosures) may exist and thus a user may get wet if the separate roof structure is not positioned over the top of both enclosures. It may also be more difficult to connect or attach adjacent tapered enclosures to one another when the separate roof structure is not used due to the tapered walls. With that said, a user can simply use a separate roof structure to couple adjacent tapered tents to one another.

Figure 5:
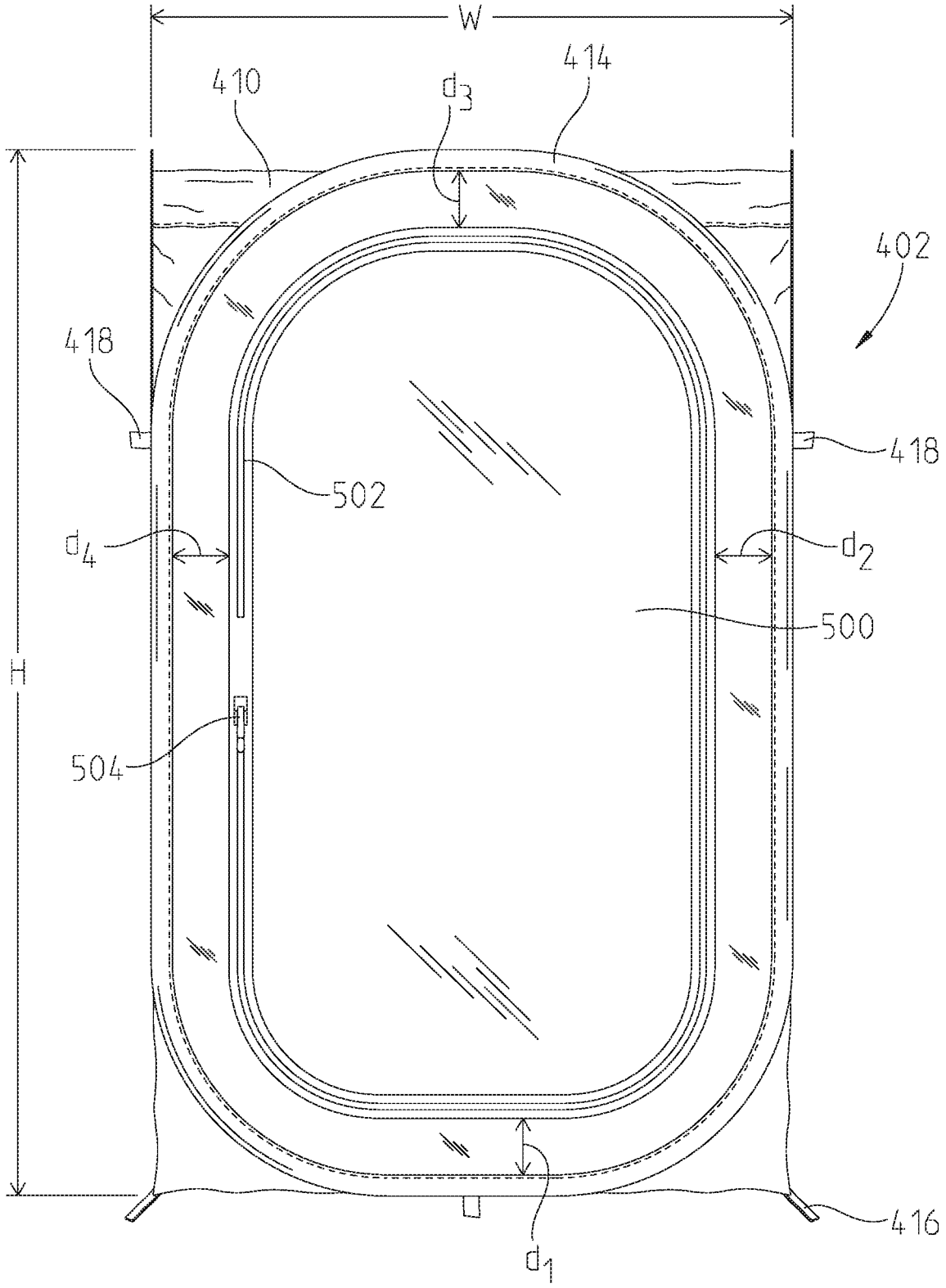
FIG. 5 is a front view of the personal enclosure of FIG. 4.

Referring to FIGS. 5-8, different walls of the enclosure 400 are shown in greater details. In FIG. 5, for example, the front wall 402 is shown with a door 500. The door 500 is shown occupying the majority of the front wall 402, and it may be opened or closed via a zipper 502. A zipper pull 504 may be provided for manipulating the zipper. As shown, the door 500 is spaced from each edge of the front wall 402 by a distance. For example, at the bottom of the front wall, a distance d1 separates the door 500 from the outer edge of the front wall 402. The door 500 is separated by distance d2 along the right side of FIG. 5, by distance d3 at the top, and by distance d4 along the left side. In one aspect, the distance between the door 500 and the outer edge of the front wall 402 may be the same. Alternatively, the distance may differ at each edge. As shown in FIG. 5, the zipper pull 504 may be pulled down and around the zipper 502 to open the door 500. In doing so, a hinge is formed on the left side of the front wall 402 as shown in FIG. 5 by which the door 500 may be pivoted or otherwise moved away from the front wall 402 to allow ingress and egress through the door opening.

Figure 6:
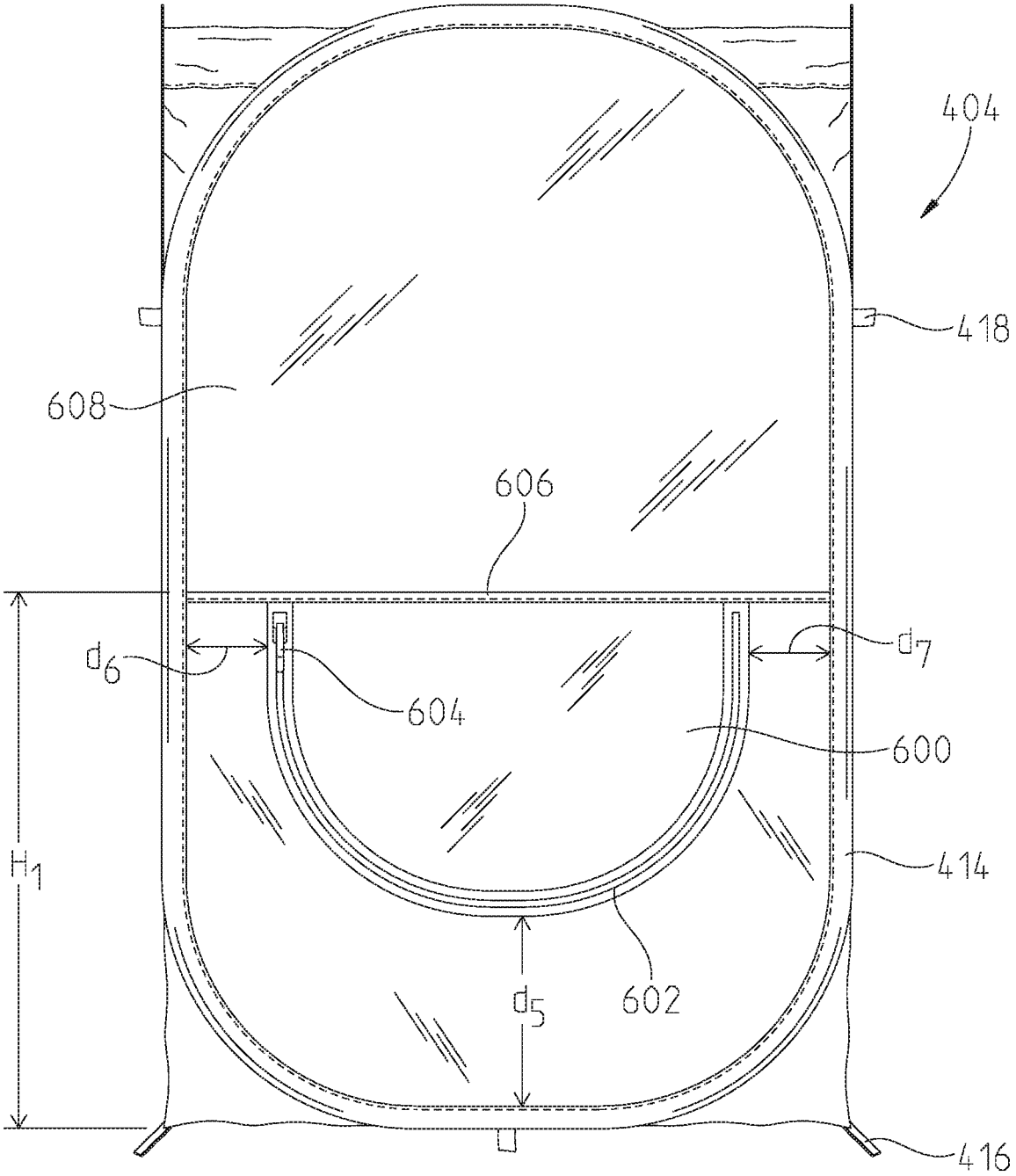
FIG. 6 is a rear view of the personal enclosure of FIG. 4.

In FIG. 6, the back wall 404 of the enclosure is shown. Here, the back wall 404 includes a window 600 formed in a lower portion thereof. In particular, the back wall 404 may have an overall height as shown in FIG. 6, and a seam 606 is defined at a height H1 from the bottom edge of the wall. The upper portion of the back wall 404 includes a cover 608.

The window 600 may be opened via a zipper 602. A zipper pull 604 may be used to manipulate the zipper and open the window 600. The window 600 has a semicircular shape as shown in FIG. 6. A bottom edge of the window 600 is disposed at a distance d5 from the bottom edge of the back wall 404. The window is spaced a distance d6 from a left edge of the back wall 404 and by a distance d7 from a right edge thereof. These distances may be the same in one embodiment, whereas in other embodiments these distances may differ. In FIG. 6, the side distances d6 and d7 may be less than the bottom distance d5. In other embodiments, the entire bottom half or top half of the back wall 404 may form a window such that each distance is approximately zero. Other window sizes are contemplated in this disclosure.

Figure 7:
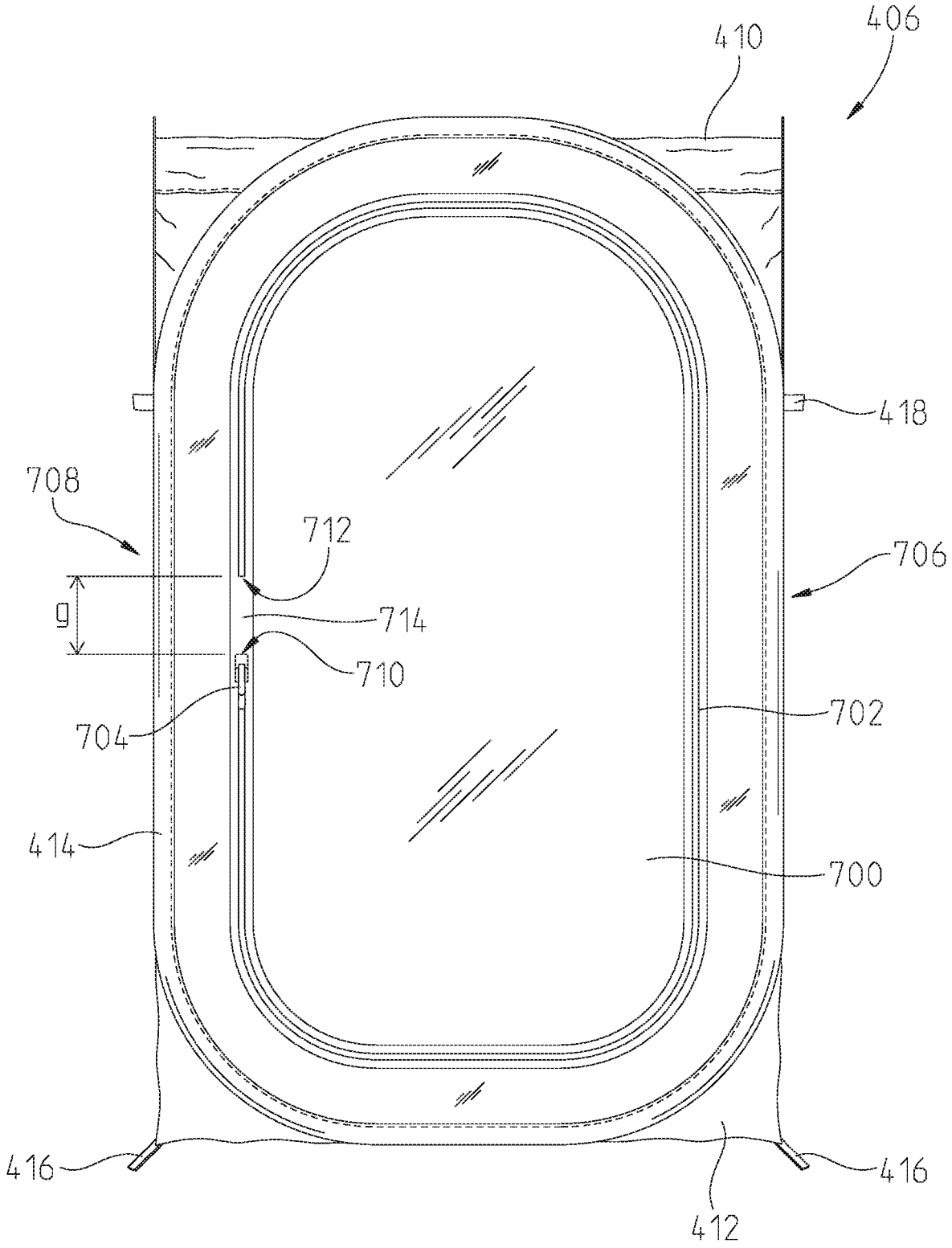
FIG. 7 is a first side view of the personal enclosure of FIG. 4.

Referring to FIG. 7, a door 700 is defined in the first side wall 406. The door 700 may be removably coupled to the first side wall 406 by a zipper 702. A zipper pull 704 may be used to manipulate the zipper 702 so that the door may be configured in an open position, a closed position, or any position therebetween. As shown, the zipper 702 has a first end 710 and a second end 712. The zipper pull 704 is disposed at the first end 710 when the door 700 is in the closed position, whereas the zipper pull 704 may be disposed at the second end 712 when the door 700 is in the open position.

In FIG. 7, there is a non-zipper area 714 defined in the first side wall 406 between the first zipper end 710 and the second zipper end 712. This area 714 may be defined by a space or gap "g" as shown in FIG. 7. As also shown in FIG. 7, the non-zipper area 714 is located on the first side wall 406 at a location towards a back side 708 of the enclosure 400. For sake of clarity, the back wall 404 is located towards the back side 708 of the enclosure 400, and the front wall 402 is located towards a front side 706 thereof. In this embodiment, the non-zipper area 714 can function as a door hinge. As the zipper pull 704 manipulates the zipper 702 such that the door 700 is fully opened, i.e., the zipper pull 704 is located at the second zipper end 712, the door 700 can be pulled or folded towards the back side 708 of the enclosure. A coupling mechanism such as Velcro®, a snap, latch, hook, or other means may be used for coupling the door 700 to the back wall 404 or at least to a back side 708 of the enclosure 400. Thus, if a user is occupying the enclosure 400 and the door 700 is opened, the door 700 is disposed on the back side 708 of the enclosure 400 rather than the front side 706 which may interfere or obstruct the view of the user while inside the enclosure. This of course may be reversed in other embodiments where the door is capable of being folded or disposed on the front side 706 of the enclosure. In yet a further embodiment, it may be possible to completely remove the door 700 from the first side wall 406.

In an alternative embodiment, the door 700 may be removably coupled to the first side wall 406 by a coupling means other than a zipper. Other selectively engageable mechanisms such as snaps, clips, latches, hooks, and the like may be used for selectively coupling the door to the wall.

Figure 8:
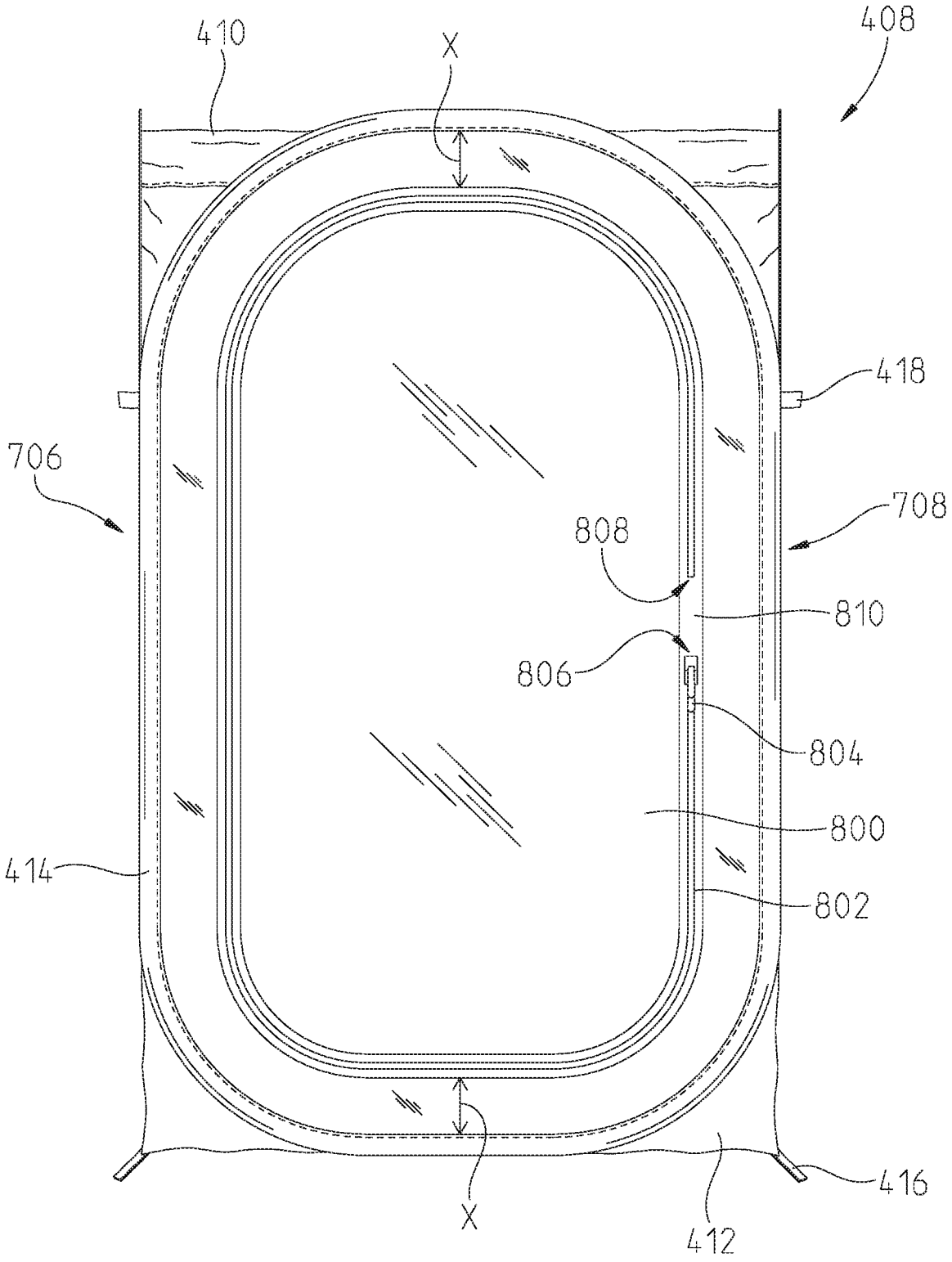
FIG. 8 is a second side view of the personal enclosure of FIG. 4.

In FIG. 8, the second side wall 408 is shown. The teachings of FIG. 7 may apply to FIG. 8 as well. Here, a second door 800 is formed in the second side wall 408, where the door 800 occupies a substantial portion of the wall. For example, the door 800 may be spaced by a distance "x" from the outer edge of the second side wall 408. In other embodiments, the distance may differ between the door and outer edge of the second side wall. In one non-limiting example, the distance "x" may be between 2-10 inches. In a second non-limiting example, the distance "x" may be less than 20 inches. In a further non-limiting example, the distance "x" may be approximately zero inches. The distance "x" may be any value based on the desired size of the door 800 with respect to the side wall.

Like FIG. 7, the door 800 may be selectively engaged with the second side wall 408 via a zipper 802. The zipper 802 may be manipulated by a zipper pull 804, as shown in FIG. 8. The zipper 802 may include a first zipper end 806 and a second zipper 808, where a non-zipper area 810 is defined therebetween so that the door 800 may be disposed towards the back side 708 of the enclosure 400. In this way, the non-zipper area 810 may function similar to a hinge.

Figure 9:
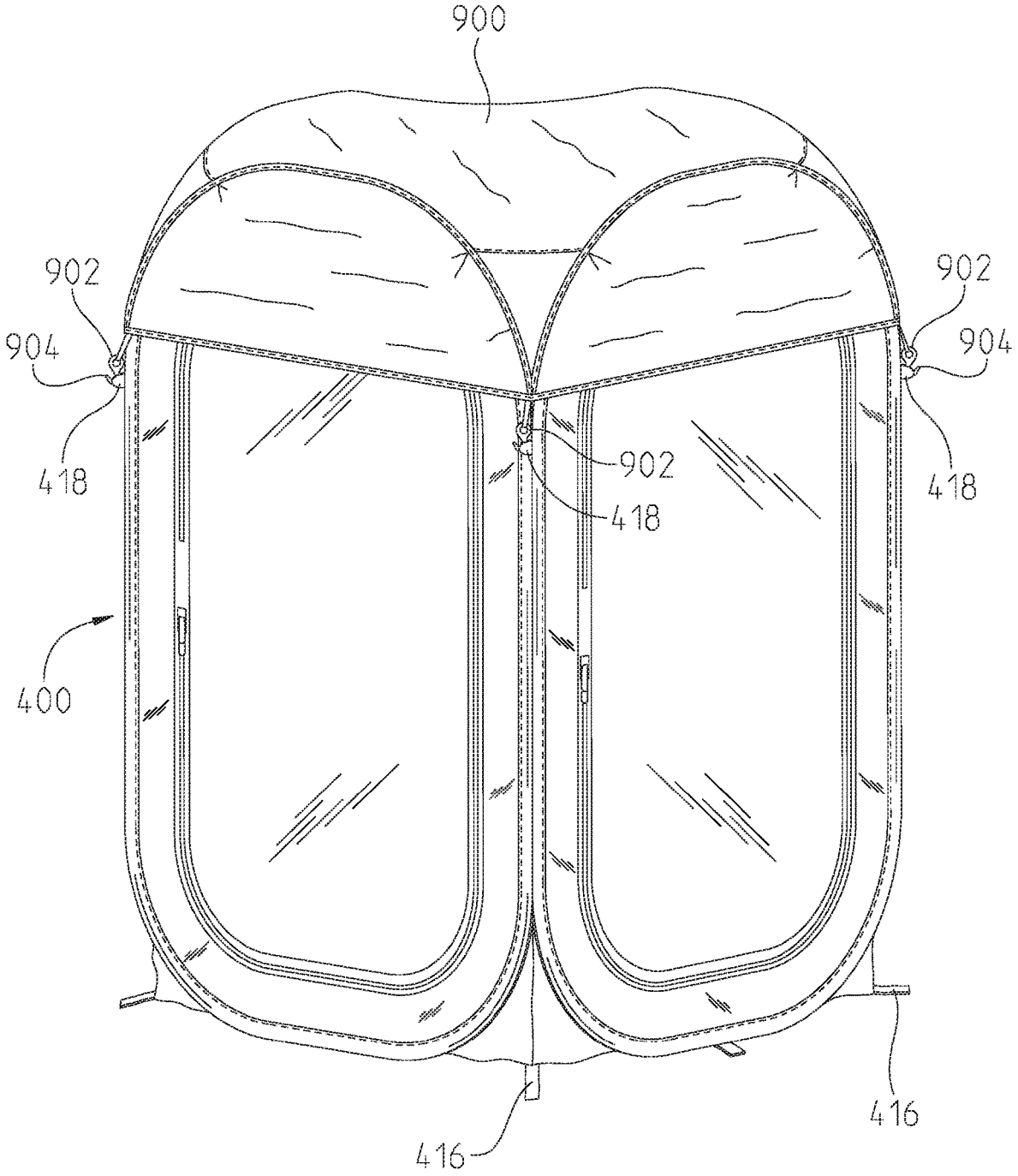
FIG. 9 is a perspective view of a second embodiment of a personal enclosure.

In an alternative embodiment shown in FIG. 9, the enclosure 400 is shown having a removably coupled roof structure 900. The roof structure 900 is sized to fit over the top wall 410 of the enclosure 400 and at least an upper portion of the front wall 402, back wall 404, first side wall 406, and second side wall 408. The roof structure 900 may be formed of a nylon material, although it can be made of any elastic or semi-elastic material that allows it to stretch. While being elastic is desirable in at least one embodiment, in other embodiments the roof structure 900 may be non-elastic but sized to fit properly over the enclosure 400.

The roof structure 900 may include one or more connectors 902. Each connector 902 may include a hook end 904 as shown in FIG. 9. Here, each connector 902 may engage or couple to one of the straps 418 on the enclosure 400 for coupling the roof structure 900 thereto. The hook end 904 may fit through an opening formed in the strap 418 to complete the coupling step. When coupled, the roof structure 900 may provide additional protection from rain, water, snow, wind, insects, and the like. Moreover, the roof structure 900 may be used for coupling two or more enclosures to one another to form a multi-enclosure assembly.

Figure 10:
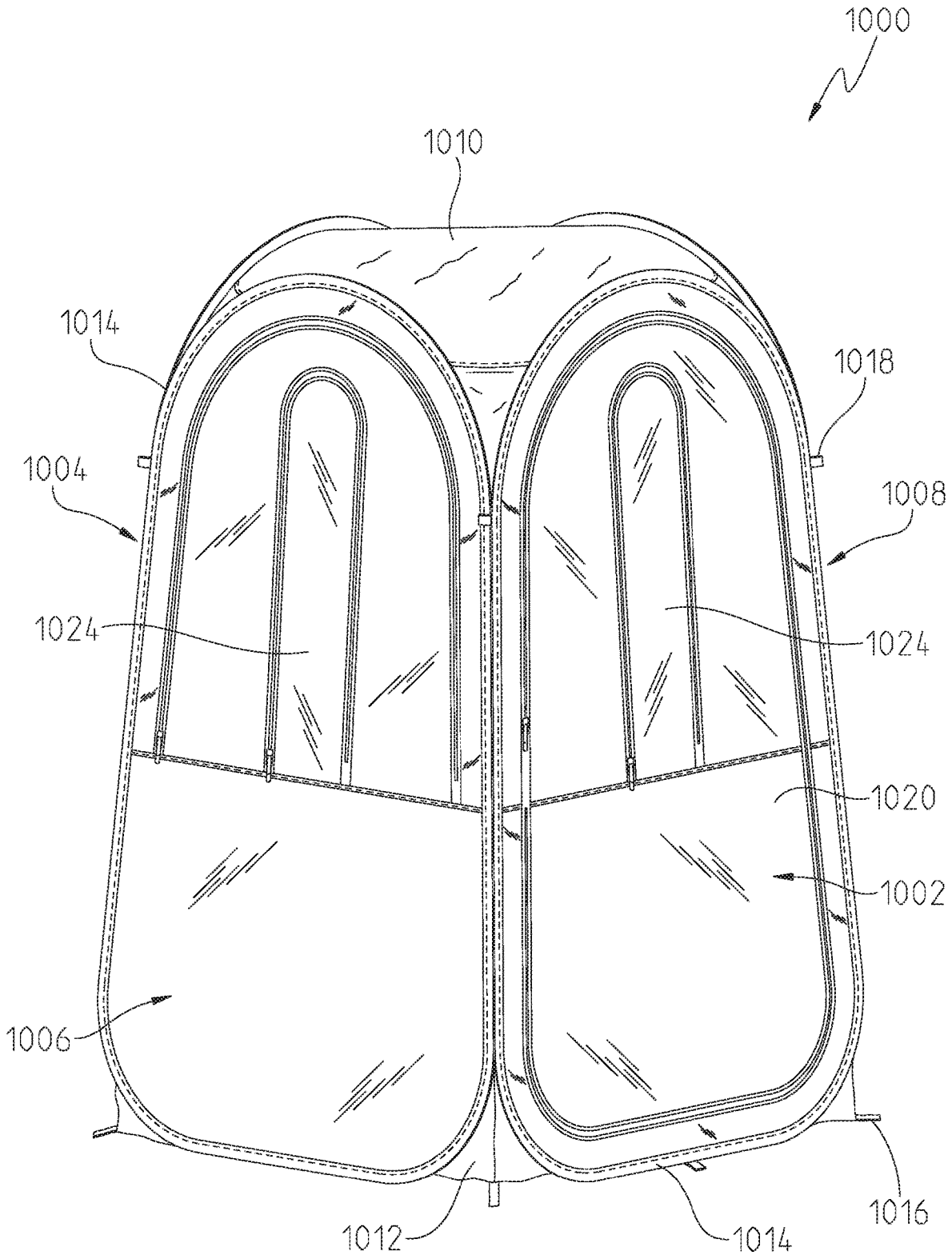
FIG. 10 is a perspective view of a third embodiment of a personal enclosure.

Referring to FIG. 10, another embodiment of an enclosure 1000 is shown. This enclosure 1000 is a tapered enclosure whereby the base of the enclosure is greater than its top. The enclosure 1000 may include a front wall 1002, a back wall 1004, a first side wall 1006, a second side wall 1008, a top wall 1010, and a bottom wall 1012. With a tapered design, the bottom wall 1012 is larger than the top wall 1010. The front, back and side walls may be formed by individual frame members 1014. Each frame member 1014 may have a circular, oval, or egg-like shape. This disclosure, however, is not limited to these shapes and the frame member 1014 may include rectangular, triangular, square, pentagon, hexagon, octagon, or any other type shape.

In this illustrated embodiment, the front, back and side walls are shown as being substantially transparent. This disclosure is not limited to color, size, shape or tint of the different walls. In some embodiments, each wall may be transparent. In other embodiments, each wall may be semi-transparent. In yet other embodiments, each wall may be opaque or non-transparent. In yet further embodiments, the walls may be a combination of transparent, semi-transparent, and non-transparent. In FIG. 6, for example, the upper back cover 608 may be a solid, non-transparent material whereas the window 600 may be transparent. Each embodiment described in this disclosure may have any combination of transparency, and a user may selectively purchase a type of enclosure based on his or her own desire.

Returning to the illustrated embodiment of FIG. 10, the enclosure 1000 may also include anchor straps or loops 1016 and roof-connecting straps 1018 similar to those previously described. In the front wall 1002, a door 1020 may be formed. The door 1020 may be selectively engaged to the front wall 1002 via a zipper or any other coupling means. The door 1020 may occupy a substantial portion of the front wall 1002, although this is not necessary in all embodiments. Rather, in some embodiments, the door 1020 may be sized appropriately for intended use. For example, an enclosure designed for children may have a smaller door than the one shown in FIG. 10.

Figure 11:
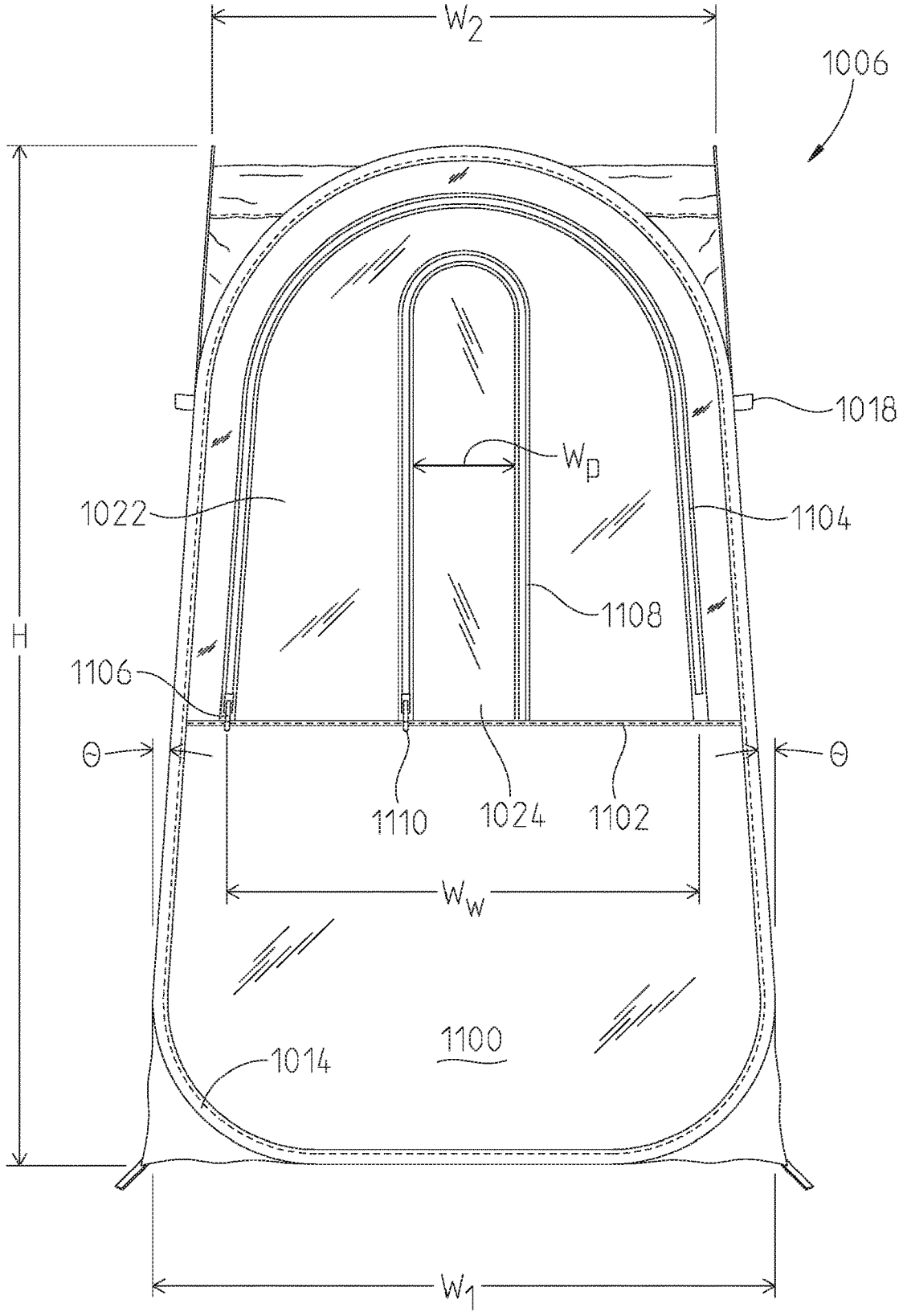
FIG. 11 is a side view of the personal enclosure of FIG. 10.

As shown in FIG. 11, a window 1022 may be formed in the back wall 1004, first side wall 1006, or second side wall 1008. The window 1022 may be selectively coupled to the respective wall via a zipper 1104 (FIG. 11) or any other coupling means. A zipper pull 1106 may be used to selectively open or close the window 1022. In FIG. 11, a seam 1102 may separate the first side wall 1006 into a first or top portion and a second or bottom portion. The window 1022 may be formed in the first portion of the side wall, whereas a solid cover 1100 may be formed in the second portion.

In the embodiment of FIGS. 10 and 11, the enclosure 1000 may include one or more secondary windows 1024. The secondary window 1024 may be used by a photographer, for example, for selectively opening so that a camera may extend therethrough and photograph or record an event (e.g., a youth sporting event). The secondary window 1024 may be formed in either the door 1020 or window 1022, as shown in FIG. 10. The secondary window 1024 may be selectively coupled to the front wall 1002 or door 1020, or the first side wall 1006 or window 1022, via a zipper 1108. A second zipper pull 1110 may be used to manipulate the zipper for selectively opening or closing the secondary window 1024.

Referring to FIG. 11, the secondary window 1024 is formed inside of the window 1022. The window 1022 may have a width Ww as shown in FIG. 11, whereas the secondary window 1024 may have a width of Wp. Here, Ww is greater than Wp. The secondary window 1024 may have a bottom edge that aligns with the seam 1102, and has a narrower opening when opened compared to the window 1022. In one non-limiting example, the secondary window may have a width that is approximately ¼ of the width of the window 1022. In another example, the secondary window 1024 may be sized with a width less than ½ of the window 1022. Other comparable sizes are possible with other embodiments.

As previously described, the enclosure 1000 is designed as a tapered enclosure. Here, each wall may have a base or bottom edge with a width W1 and a top edge with a width of W2. The side edge of each wall gets narrower as it moves from the bottom edge towards the top edge. The narrowing of the wall may correspond with an angle Θ as shown in FIG. 11. The angle Θ may be less than 30°. In another embodiment, angle Θ may be less than 15°. Yet further, the angle Θ may be between approximately 2-10°.

Although the secondary window 1024 is shown and described with respect to the tapered design, it is understood that the secondary window 1024 may also be used with the upright or square design of FIG. 4. Thus, the secondary window 1024 is like other features described herein such that it may be used with any of the different enclosures.

Figure 12:
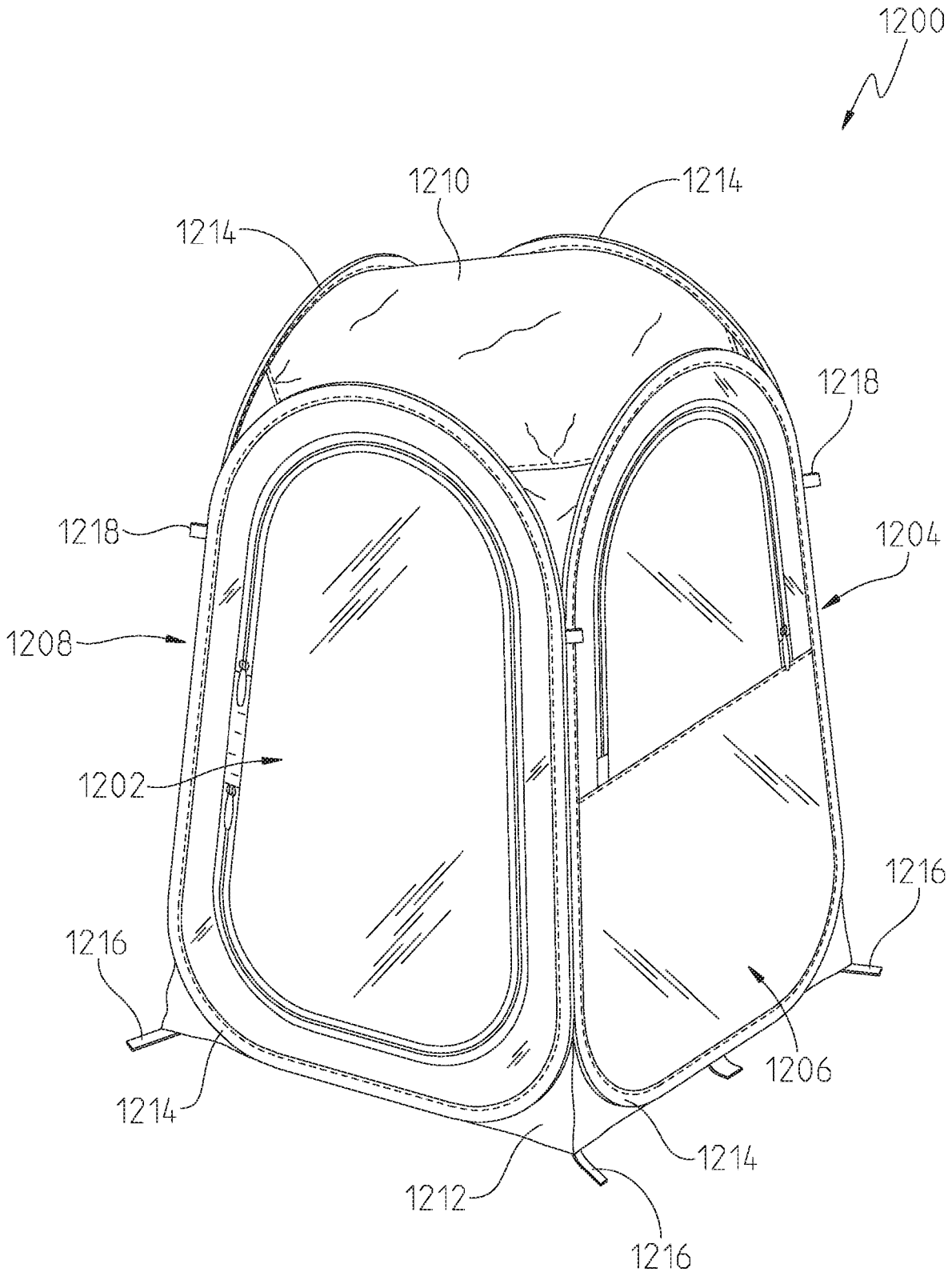
FIG. 12 is a perspective view of a fourth embodiment of a personal enclosure.

A further embodiment of an enclosure 1200 is shown in FIG. 12. The enclosure 1200 is similar to the previously described enclosure 1000 of FIG. 10, albeit without the secondary windows. In FIG. 12, the enclosure 1200 may include a front wall 1202, a back wall 1204, a first side wall 1206, a second side wall 1208, a top wall 1210, and a bottom wall 1212. With a tapered design, the bottom wall 1212 is larger than the top wall 1210. The front, back and side walls may be formed by individual frame members 1214. Each frame member 1214 may have a circular, oval, or egg-like shape. This disclosure, however, is not limited to these shapes and the frame member 1214 may include rectangular, triangular, square, pentagon, hexagon, octagon, or any other type shape.

The enclosure 1200 may also include anchor straps or loops 1216 and roof-connecting straps 1218 similar to those previously described. Thus, a removable roof similar to that shown in FIG. 9 may be used with the enclosure 1200 of FIG. 12.

Figure 14:
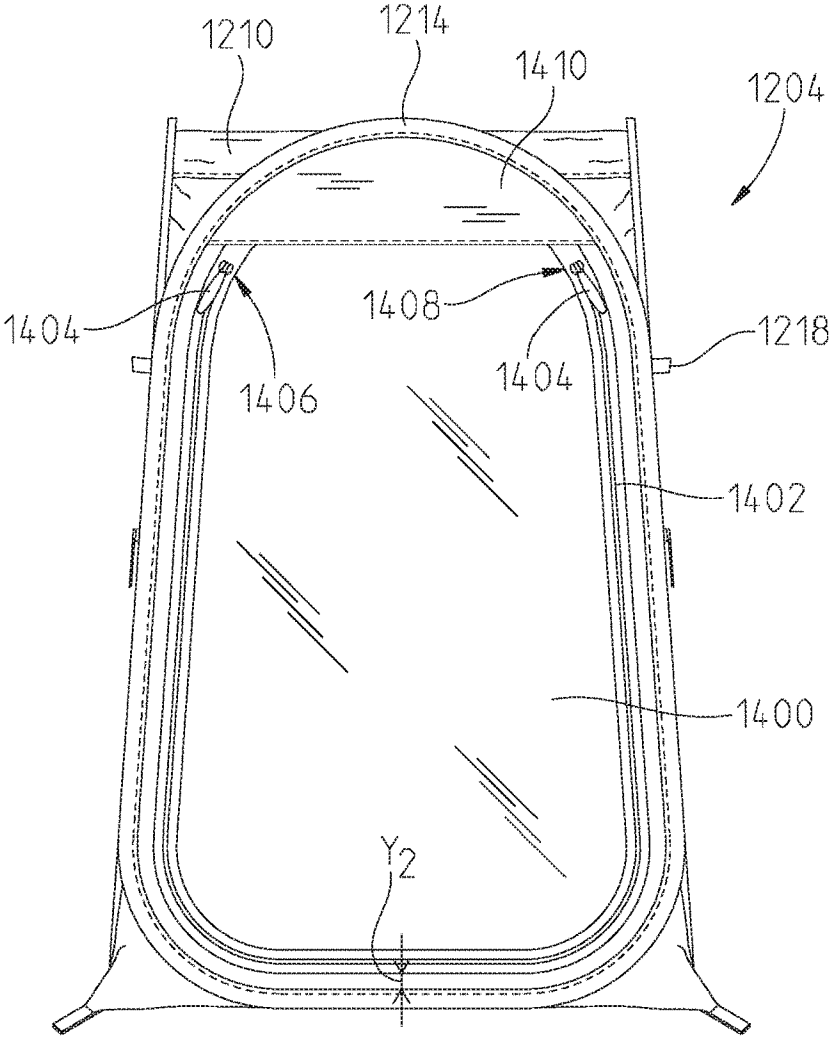
FIG. 14 is a rear view of the personal enclosure of FIG. 12.
Figure 13:
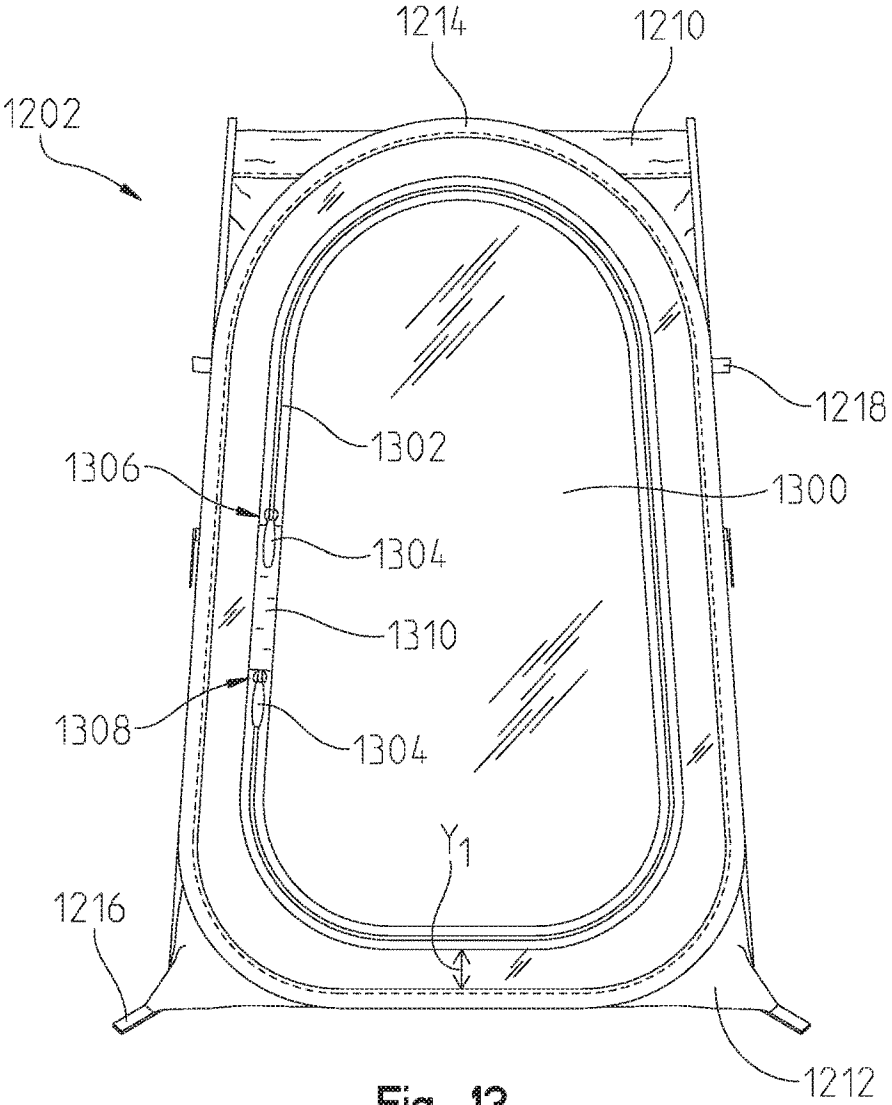
FIG. 13 is a front view of the personal enclosure of FIG. 12.

In FIGS. 13 and 14, the enclosure 1200 is shown in greater detail. In FIG. 13, for example, the front wall 1202 is shown and in FIG. 14 the back wall 1204 is shown. The front wall 1202 is shown with a door 1300 defined therein. The door 1300 may occupy a substantial portion of the front wall 1202 with only a space y1 separating the edge of the door 1300 from the outer edge of the door 1300. The door 1300 may be selectively coupled to the front wall 1202 via a zipper 1302. The zipper 1302 may be manipulated between an open and closed position via a zipper pull 1304. In FIG. 13, there are two zipper pulls 1304 shown. In other embodiments, there may be any number of zipper pulls and so two pulls is not required.

The zipper 1302 has a first zipper end 1306 and a second zipper end 1308. An area 1310 between the zipper ends defines a hinge-like area where the door 1300 can be pivoted or folded to a different side of the enclosure. In FIG. 13, the hinge 1310 is located on the left side of the door 1300, but this may differ in other embodiments. For example, the hinge 1310 may be located on the top or right side of the wall. If on the top side, then the door 1300 may be opened and folded on top of the top wall 1210. The door 1300 may include a connector such as Velcro®, a snap, latch, hook, or the like for engaging with another connector to fasten or hold the door in its open position.

In FIG. 14, the back wall 1204 of the enclosure 1200 is shown. Here, the back wall 1204 may include a second door 1400 defined therein. The door 1400 may be selectively coupled to the back wall 1204 via a zipper 1402. One or more zipper pulls 1404 may be used to manipulate the zipper 1402 between its open and closed position. Likewise, the zipper 1402 may include a first zipper end 1406 and a second zipper end 1408. In FIG. 14, the door 1400 is such that the zipper ends are disposed near the top of the back wall 1204. A shade or cover 1410 is formed at a location between or above the zipper 1402.

As shown in FIG. 14, the door 1400 may have a bottom edge that is spaced from the bottom edge of the back wall 1204 by a distance y2. This distance y2 is smaller than distance y1 of FIG. 13. Distance y2 may be less than 1-2 inches. In another embodiment, it may be less than 5 inches. In any event, the distance y2 is less than distance y1. With a smaller gap separating the bottom of the door 1600 from the bottom of the wall (and, thus the ground surface), a wheelchair may be easily transported into the enclosure 1200 through the door opening.

Figure 15:
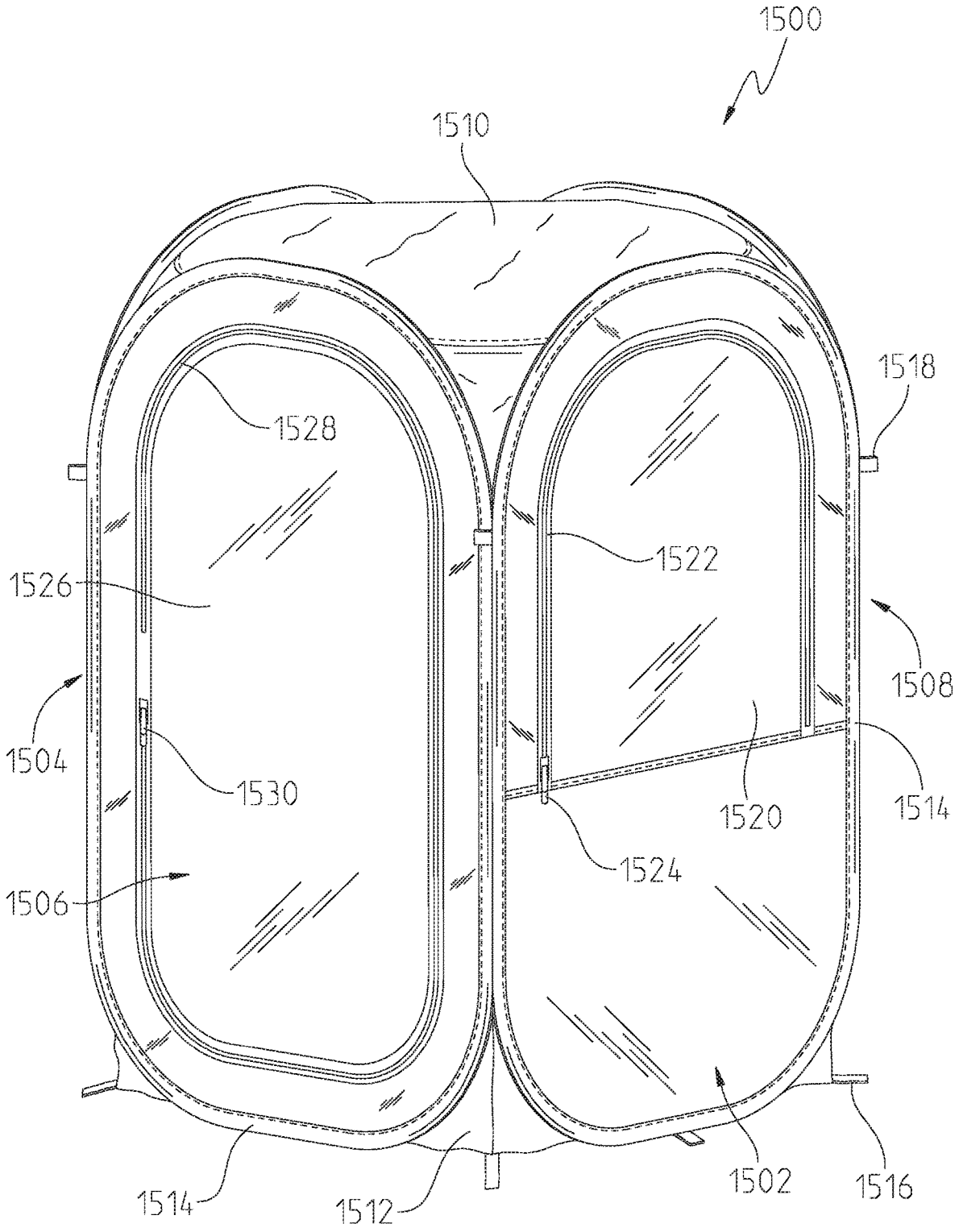
FIG. 15 is a perspective view of a fifth embodiment of a personal enclosure.

In FIG. 15, a different embodiment of an enclosure 1500 is shown. The enclosure 1500 may include a plurality of walls similar to those previously described. Here, the enclosure 1500 includes a front wall 1502, a back wall 1504, a first side wall 1506, a second side wall 1508, a top wall 1510, and a bottom wall 1512. Similar to the previous embodiments, a frame member 1514 may provide support to each wall, and in particular to the front, back and side walls. The enclosure 1500 may include anchoring straps or loops 1516 for anchoring the enclosure 1500 in place.

Figure 16:
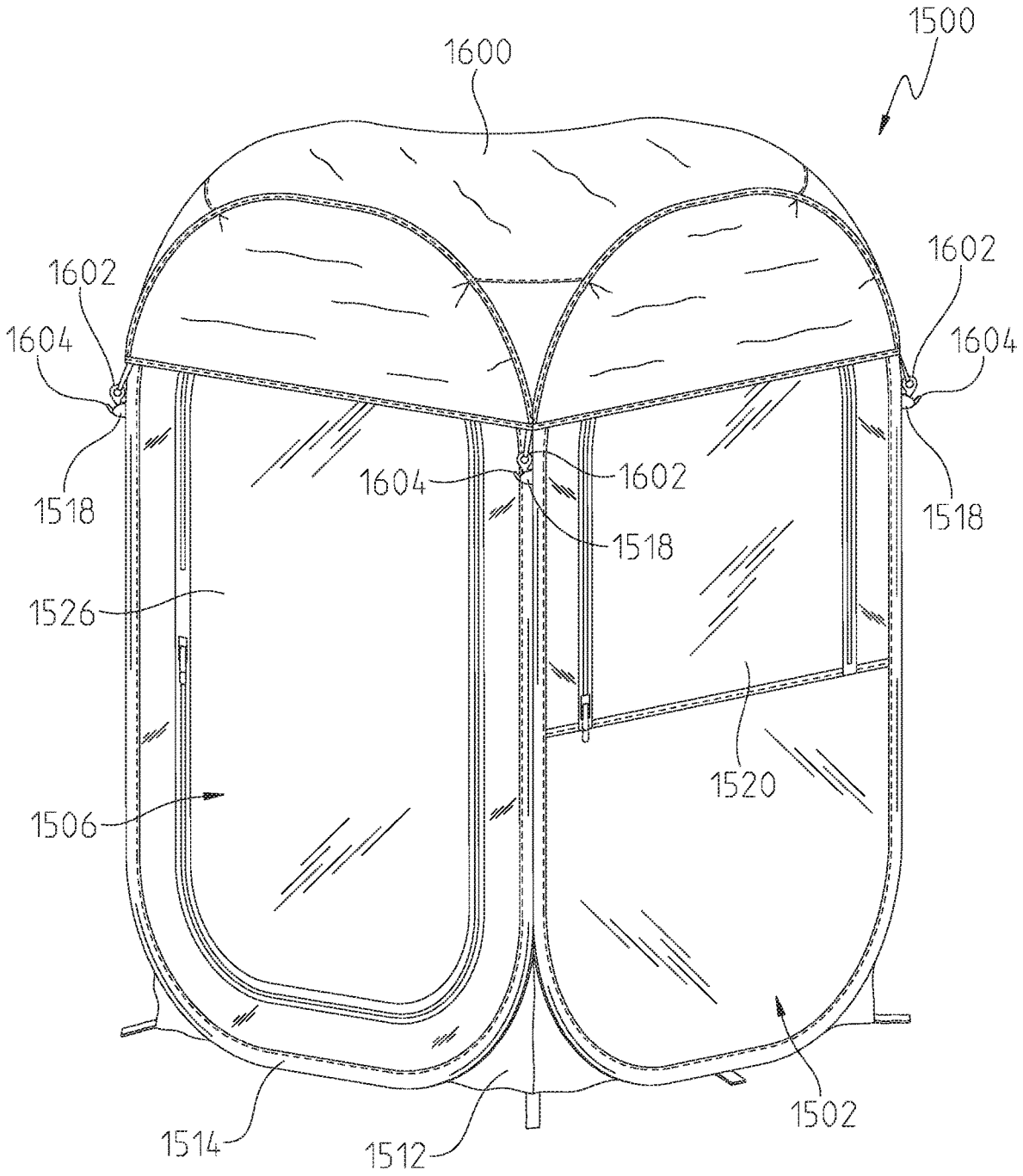
FIG. 16 is a perspective view of a sixth embodiment of a personal enclosure.

Straps 1518 may be coupled at one or more locations on the enclosure 1500 for coupling to a roof structure 1600 as shown in FIG. 16. Here, the roof structure 1600 may include one or more connectors 1602 that each include a hook end 1604. The hook end 1604 may be disposed through an opening in a strap 1518 for coupling the roof structure 1600 to the enclosure 1500.

The enclosure 1500 may also include a window 1520 defined in the front wall 1502. The window 1520 may be selectively engaged with the front wall 1502 via a zipper 1522. A zipper pull 1524 may be used to manipulate the zipper 1522 to position the window 1520 between an open and closed position.

A door 1526 may be formed in at least the first side wall 1506 to allow a user to enter or exit the enclosure 1500. The door 1526 may be selectively engaged with the side wall via a zipper 1528. One or more zipper pulls 1530 may be used to manipulate the zipper 1528 so that the door 1526 may be opened or closed.

Figure 17:
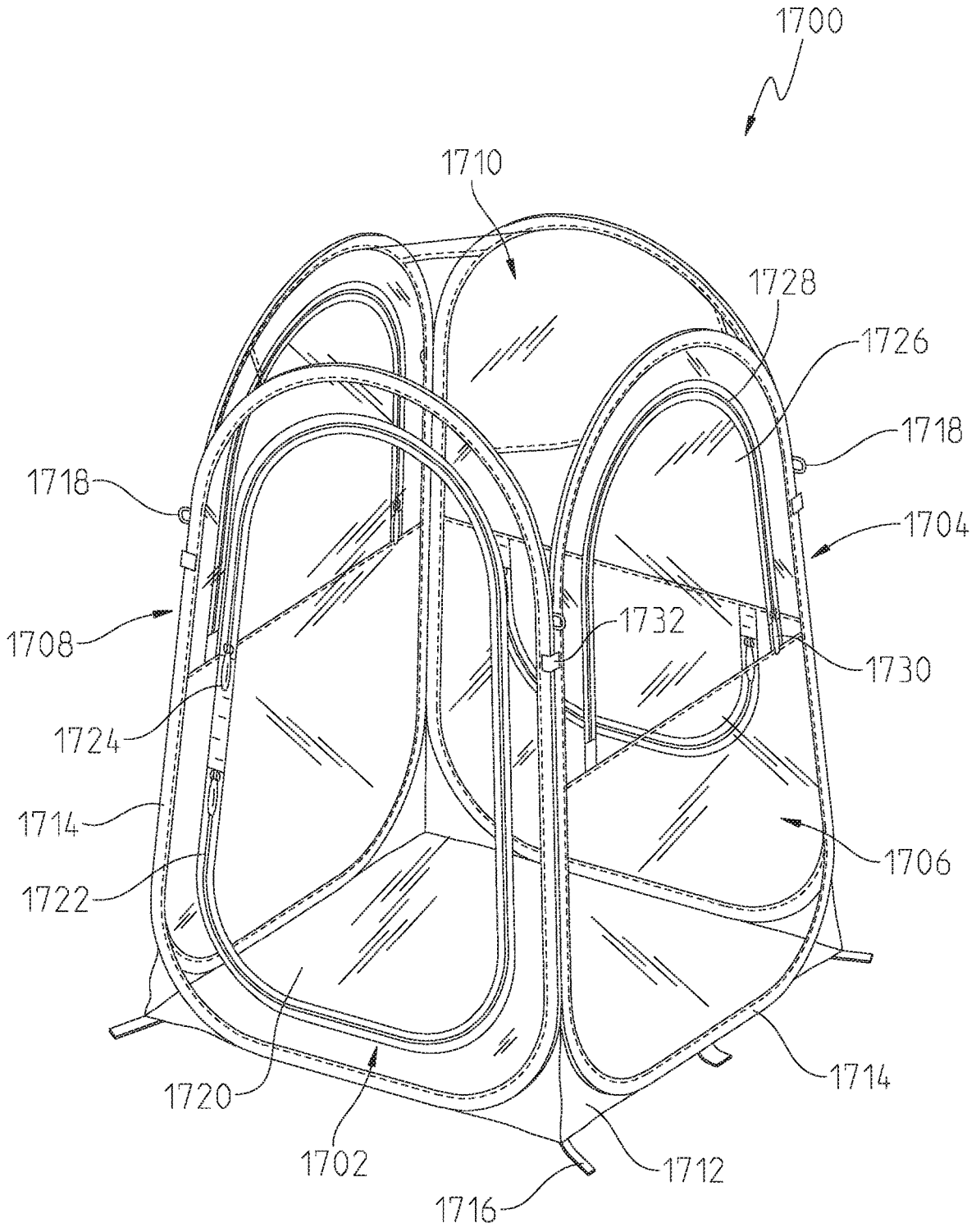
FIG. 17 is a perspective view of a seventh embodiment of a personal enclosure.

A further embodiment of an enclosure 1700 is shown in FIG. 17. This enclosure 1700 includes a tapered design with a plurality of walls. For instance, the enclosure 1700 may include a front wall 1702, a back wall 1704, a first side wall 1706, a second side wall 1708, a top wall 1710, and a bottom wall 1712. Similar to the previous embodiments, a frame member 1714 may provide support to each wall, and in particular to the front, back and side walls. The enclosure 1700 may include anchoring straps or loops 1716 for anchoring the enclosure 1700 in place, and straps or hooks 1718 for coupling to a separate roof structure (not shown).

The front wall 1702 may include a door 1720 defined therein, and the first side wall 1706 may include a window 1726 defined therein. The door 1720 may be selectively engaged to the front wall 1702 via a zipper 1722. A zipper pull 1724 may be used to manipulate the zipper 1722 so that the door 1720 may be opened or closed. Similarly, the window 1726 may be selectively coupled to the first side wall 1706 via a zipper 1728. A zipper pull 1730 may be used to manipulate the window 1726 between an open and closed position. As also shown in FIG. 17, one or more reinforcement tabs 1732 may be coupled between adjacent walls to provide additional support. The tabs 1732 may couple frame members of adjacent walls in a way that the tabs clip to each frame member. In any event, the tabs 1732 provide additional support and rigidity to the overall enclosure 1700. These tabs may be used on any of the aforementioned enclosures.

As previously described, each enclosure may be designed so that it can be collapsed to a storage or transport position. This allows the enclosure to be easily stored in a trunk of a vehicle and transported to a sporting event, concert, or the like. Likewise, the enclosure may be easily configured from its collapsed, storage position to its upright position for use at the event. The frame members of each respective wall may be such that the enclosure readily and easily biases towards its upright position. This is similar to a pop-up style tent that requires no tools or assembly.

Figure 19:
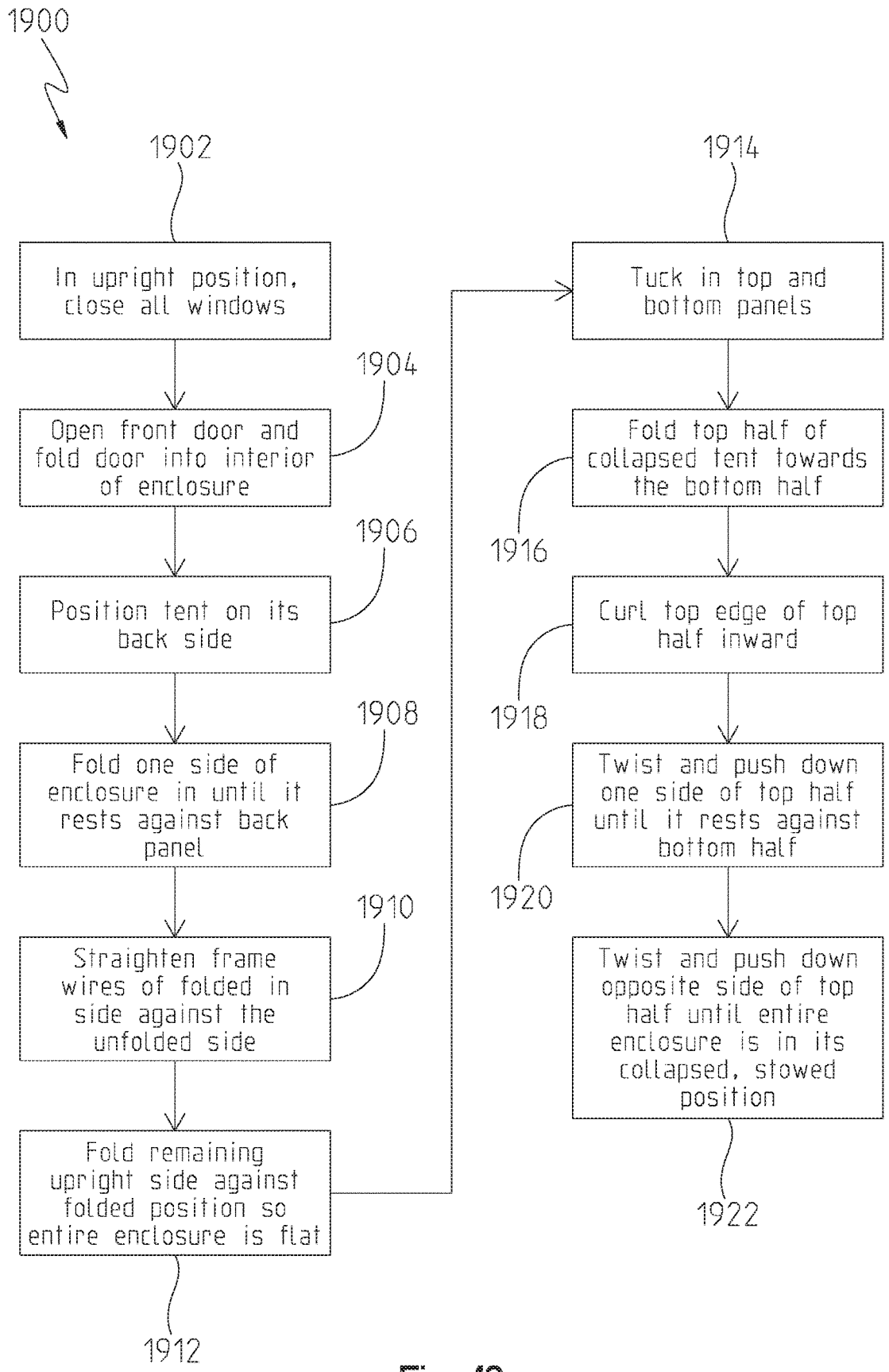
FIG. 19 is a flow diagram of a method for folding a personal enclosure from its upright position to its collapsed position.

Referring to FIG. 19, a process or method 1900 of folding or otherwise collapsing an upright enclosure to its stored position is shown. The method 1900 includes a plurality of blocks for execution. Each block may include one or more steps for completing the process. This process is only one example, and other methods may be used for collapsing an enclosure.

In FIG. 19, the method 1900 may be executed with the enclosure in its upright position as shown, for example in FIG. 4. For purposes of this embodiment, reference will be made to the enclosure 400 of FIG. 4, but it is understood the same process may be used with any of the enclosures described in this disclosure. In block 1902, any window 600 is closed. Once all windows are closed, the method 1900 can advance to block 1904 where one of the doors is opened. In FIG. 4, for example, the front door 500 may be opened by unzipping the zipper 502 with the zipper pull 504. Once opened, the front door 500 may be folded or otherwise positioned within the interior of the enclosure 400.

Once the front door 500 is disposed in the interior of the enclosure 400, the method may advance to block 1906 where the enclosure 400 is repositioned so that the back wall 404 of the enclosure 400 is resting on the ground. In this position, the method 1900 advances to block 1908 where one side such as the first side wall 406 is folded inwardly and against the back wall 404. In doing so, the frame member 414 of the first side wall 406 may become bent or not properly aligned. Thus, in block 1910, the frame member 414 of the first side wall 406 is straightened and aligned with the frame member 414 of the back wall 404 and the frame member 414 of the second side wall 408.

Once the frame member 414 of the first side wall 406 is properly aligned, method 1900 can advance to block 1912 where the second side wall 408 may be folded inwardly and into contact with the first side wall 406. In this arrangement, the second side wall 408 is disposed on top of the first side wall 406, which is disposed on top of the back wall 408. The front wall 402 may be folded inwardly with either the first side wall 406 or the second side wall 408 such that each of the front, back, and both side walls are stacked on top of one another and the enclosure 400 is now substantially flat against the ground.

Once block 1912 is executed, method 1900 can advance to block 1914 where the top and bottom walls are tucked in between the front, back and side walls to form a collapsed enclosure. Method 1900 can advance to block 1916 where a user can fold a top half of the collapsed enclosure towards the bottom half thereof. With a space or gap defined between the folded over top half of the collapsed enclosure and the bottom half, in block 1918 the top edge of the top half may be curled inwardly (i.e., down) towards the bottom half. In block 1920, the method 1900 is further executed by twisting and pushing down one edge or side of the top half of the collapsed enclosure until it rests against the collapsed bottom half. In this position, block 1922 can be executed by twisting and pushing down the opposite edge or side of the top half until the entire enclosure is in its collapsed or folded configuration. In this configuration, the enclosure may be easily stored or transported. Moreover, in this position, the enclosure is roughly half or less than half its size when it was in the flat configuration of block 1912.

In the present disclosure, an enclosure may be provided or packaged as a kit. A kit may include one or more stakes that can be used to hold the enclosure securely in place with the ground. In addition, a carry case or bag may be part of the kit for storing the enclosure and stakes when the enclosure is disposed in its collapsed configuration.

While exemplary embodiments incorporating the principles of the present disclosure have been disclosed hereinabove, the present disclosure is not limited to the disclosed embodiments. Instead, this application is intended to cover any variations, uses, or adaptations of the invention using its general principles. Further, this application is intended to cover such departures from the present disclosure as come within known or customary practice in the art to which this disclosure pertains and which fall within the limits of the appended claim.

What is claimed is:

1. A collapsible enclosure for accommodating a user, comprising:

a body formed by a plurality of walls including at least a front wall, a back wall, a first side wall, a second side wall, a top wall, and a bottom wall coupled to one another to form an interior, the interior configured to be occupied by the user;

a plurality of deformable frame members, wherein each of the front wall, the back wall, the first side wall, and the second side wall includes at least one of the plurality of deformable frame members;

a window defined in one of the front wall, back wall, first side wall and second side wall, wherein the window is selectively engageable with the respective wall such that the window is disposable between an open and closed position;

a door defined in one of the front wall, back wall, first side wall, and second side wall, wherein the door is selectively engageable with the respective wall such that the door is disposable between an open and closed position; and a removable roof structure positioned over the top wall and extending downward over an upper portion of the front wall, an upper portion of the back wall, an upper portion of the first side wall, and an upper portion of the second side wall, wherein the front wall defines a first plane and the back wall defines a second plane, the first plane and second plane are substantially parallel to one another, and further wherein the body is collapsible between an upright configuration that defines the interior and a collapsed configuration, wherein the door comprises a first door and a second door, the first door being defined in and selectively engaged with the front wall and the second door being defined in and selectively engaged with the back wall; and wherein the first door is spaced by a first distance from the bottom wall, and the second door is spaced by a second distance from the bottom wall, where the second distance is less than the first distance.

2. The collapsible enclosure of claim 1, wherein the door further comprises a third door defined in one of the first side wall and the second side wall;

the third door is selectively engageable with the one of the first side wall and the second side wall; and the third door is foldable in a direction towards the back wall when selectively disengaged from the one of the first side wall and the second side wall.

3. The collapsible enclosure of claim 1, wherein the window is defined in an upper half or lower half of the respective wall, and the door is defined in both the upper and lower halves of the respective wall.

4. The collapsible enclosure of claim 1, wherein the first side wall defines a third plane and the second side wall defines a fourth plane, the third plane and fourth plane being substantially parallel to one another, and the first and second planes being substantially perpendicular to the third and fourth planes.

5. The collapsible enclosure of claim 1, wherein the removable roof structure includes at least one connector, the at least one connector being removably coupled to the body; and at least one strap coupled to the body, the at least one strap defining an opening for receiving the at least one connector of the removable roof structure.

6. The collapsible enclosure of claim 1, further comprising:

a second window defined in and selectively engageable with one of the front, back, first side and second side walls, the second window having a height and width which are smaller than a height and width of the first window.

7. The collapsible enclosure of claim 1, further comprising:

a loop coupled to the body near the bottom wall, the loop defining an opening adapted to receive a stake.

8. The collapsible enclosure of claim 1, wherein the removable roof structure is formed of water impermeable material.

9. The collapsible enclosure of claim 1, wherein the window is substantially transparent.

10. The collapsible enclosure of claim 1, wherein at least one of the front wall, the back wall, the first side wall, and the second side wall is substantially transparent.

11. A collapsible enclosure for accommodating at least one user, comprising:

a body formed by a plurality of walls including at least a front wall, a back wall, a first side wall, a second side wall, a top wall, and a bottom wall coupled to one another to form an interior, the interior configured to be occupied by the user;

a plurality of deformable frame members, wherein each of the front wall, the back wall, the first side wall, and the second side wall includes at least one of the plurality of deformable frame members;

a door defined in one of the front wall, back wall, first side wall, and second side wall, wherein the door is selectively engageable with the respective wall such that the door is disposable between an open and closed position; and a removable roof structure positioned over the top wall and extending downward over only an upper portion of the front wall, only an upper portion of the back wall, only an upper portion of the first side wall, and only an upper portion of the second side wall, such that a bottom periphery defined by the removable roof structure remains spaced apart from the bottom wall and therefore allows continued operation of the door, wherein the front wall defines a first plane and the back wall defines a second plane, the first plane and second plane are parallel to one another, and further wherein the body is collapsible between an upright configuration that defines the interior and a collapsed configuration for storage, and wherein the front wall and the back wall are each defined by two panels in side-by-side arrangement, and the first and second side walls are defined by one panel, with each of the aforementioned panels of the front wall, the back wall, and the first and second side walls being formed with a similar shape and size as all other panels such that the front and back walls are about twice as wide as the first and second side walls, with each of the panels on the front wall and on the first and second side walls including a closeable opening in the form of a window and/or the door.

12. The collapsible enclosure of claim 11, wherein the interior is open between the first and second side walls such that a user can enter through one of the panels and exit through any other one of the panels.

13. The collapsible enclosure of claim 11, wherein each of the panels at the front and back wall and at the first and second side walls is generally rectilinear with rounded corner edges.

14. The collapsible enclosure of claim 11, wherein each of the front panels on the front wall includes a window.

15. The collapsible enclosure of claim 11, wherein each of the front panels on the front wall includes a door.

16. The collapsible enclosure of claim 11, wherein the door is substantially transparent.

17. The collapsible enclosure of claim 11, wherein at least one of the front wall, the back wall, the first side wall, and the second side wall is substantially transparent.

* * * * *